US008659520B2

(12) United States Patent
Kimura

(10) Patent No.: US 8,659,520 B2
(45) Date of Patent: Feb. 25, 2014

(54) DRIVING METHOD OF DISPLAY DEVICE

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 12/834,092

(22) Filed: Jul. 12, 2010

(65) Prior Publication Data

US 2010/0277516 A1 Nov. 4, 2010

Related U.S. Application Data

(63) Continuation of application No. 11/623,388, filed on Jan. 16, 2007, now Pat. No. 7,755,651.

(30) Foreign Application Priority Data

Jan. 20, 2006 (JP) ..... 2006-012464

(51) Int. Cl.
*G09G 3/30* (2006.01)
*G09G 5/10* (2006.01)

(52) U.S. Cl.
USPC ..... 345/77; 345/76; 345/692

(58) Field of Classification Search
USPC ..... 345/76–83, 89, 204–215, 690–699, 345/60–73; 315/169.1–169.4
See application file for complete search history.

(56) References Cited

U.S. PATENT DOCUMENTS 4,070,663 A 1/1978 Kanatani et al.
4,773,738 A 9/1988 Hayakawa et al.
5,091,722 A 2/1992 Kitajima et al.
5,200,846 A 4/1993 Hiroki et al.
5,225,823 A 7/1993 Kanaly (Continued)

FOREIGN PATENT DOCUMENTS

EP 831449 A2 3/1998
EP 838799 A1 4/1998

(Continued)

OTHER PUBLICATIONS

Inukai et al., "4.0-In. TFT-OLED Displays and a Novel Digital Driving Method", SID Digest '00 : SID International Symposium Digest of Technical Papers, vol. 31, Jan. 1, 2000, pp. 924-927.

(Continued)

*Primary Examiner* — Alexander Eisen
*Assistant Examiner* — Patrick F Marinelli
(74) *Attorney, Agent, or Firm* — Fish & Richardson P.C.

(57) ABSTRACT

It is an object to provide a driving method of a display device capable of reducing pseudo contours while increase in the number of sub-frames is suppressed as much as possible. In a driving method of a display device where one frame is divided into a plurality of sub-frames to display a gray scale, the plurality of sub-frames has a plurality of middle-order sub-frames each of which has a middle-degree weighting and is used for an overlapping time gray scale method, at least one high-order sub-frame which has a larger weighting than that of the middle-order sub-frame and is used for a binary code time gray scale method, and at least one low-order sub-frame which has a smaller weighting than that of the middle-order sub-frame and is used for a binary code time gray scale method.

18 Claims, 36 Drawing Sheets

| Gray Scales \ Lighting Periods | SF1 | SF2 | SF3 | SF4a | SF4b | SF5 | SF6 |
|---|---|---|---|---|---|---|---|
| | 4 | 4 | 4 | 8 | 8 | 1 | 2 |
| 0 | × | × | × | × | × | × | × |
| 1 | × | × | × | × | × | ○ | × |
| 2 | × | × | × | × | × | × | ○ |
| 3 | × | × | × | × | × | ○ | ○ |
| 4 | ○ | × | × | × | × | × | × |
| 5 | ○ | × | × | × | × | ○ | × |
| 6 | ○ | × | × | × | × | × | ○ |
| 7 | ○ | × | × | × | × | ○ | ○ |
| 8 | ○ | ○ | × | × | × | × | × |
| 9 | ○ | ○ | × | × | × | ○ | × |
| 10 | ○ | ○ | × | × | × | × | ○ |
| 11 | ○ | ○ | × | × | × | ○ | ○ |
| 12 | ○ | ○ | ○ | × | × | × | × |
| 13 | ○ | ○ | ○ | × | × | ○ | × |
| 14 | ○ | ○ | ○ | × | × | × | ○ |
| 14′ | × | × | ○ | ○ | × | × | ○ |
| 15 | ○ | ○ | ○ | × | × | ○ | ○ |
| 15′ | × | × | ○ | ○ | × | ○ | ○ |
| 15″ | × | × | ○ | × | ○ | ○ | ○ |
| 15a | × | ○ | × | ○ | × | ○ | ○ |
| 16 | × | × | × | ○ | ○ | × | × |
| 16′ | × | ○ | ○ | ○ | × | × | × |
| 17 | × | × | × | ○ | ○ | ○ | × |
| 18 | × | × | × | ○ | ○ | × | ○ |
| 19 | × | × | × | ○ | ○ | ○ | ○ |
| 20 | ○ | × | × | ○ | ○ | × | × |
| 21 | ○ | × | × | ○ | ○ | ○ | × |
| 22 | ○ | × | × | ○ | ○ | × | ○ |
| 23 | ○ | × | × | ○ | ○ | ○ | ○ |
| 24 | ○ | ○ | × | ○ | ○ | × | × |
| 25 | ○ | ○ | × | ○ | ○ | ○ | × |
| 26 | ○ | ○ | × | ○ | ○ | × | ○ |
| 27 | ○ | ○ | × | ○ | ○ | ○ | ○ |
| 28 | ○ | ○ | ○ | ○ | ○ | × | × |
| 29 | ○ | ○ | ○ | ○ | ○ | ○ | × |
| 30 | ○ | ○ | ○ | ○ | ○ | × | ○ |
| 31 | ○ | ○ | ○ | ○ | ○ | ○ | ○ |

○ : Lighting
× : non-Lighting

(56) References Cited

U.S. PATENT DOCUMENTS

| | | | | |
|---|---|---|---|---|
| 5,302,966 | A | 4/1994 | Stewart | |
| 5,309,552 | A | 5/1994 | Horton et al. | |
| 5,349,366 | A | 9/1994 | Yamazaki et al. | |
| 5,412,493 | A | 5/1995 | Kunii et al. | |
| 5,414,442 | A | 5/1995 | Yamazaki et al. | |
| 5,424,752 | A | 6/1995 | Yamazaki et al. | |
| 5,471,225 | A | 11/1995 | Parks | |
| 5,479,283 | A | 12/1995 | Kaneko et al. | |
| 5,583,534 | A | 12/1996 | Katakura et al. | |
| 5,600,169 | A | 2/1997 | Burgener et al. | |
| 5,642,129 | A | 6/1997 | Zavracky et al. | |
| 5,642,213 | A | 6/1997 | Mase et al. | |
| 5,680,190 | A * | 10/1997 | Michibayashi et al. | 349/140 |
| 5,712,652 | A | 1/1998 | Sato et al. | |
| 5,729,308 | A | 3/1998 | Yamazaki et al. | |
| 5,767,828 | A | 6/1998 | McKnight | |
| 5,798,746 | A | 8/1998 | Koyama | |
| 5,818,419 | A * | 10/1998 | Tajima et al. | 345/691 |
| 5,969,710 | A | 10/1999 | Doherty et al. | |
| 5,973,655 | A | 10/1999 | Fujisaki et al. | |
| 5,986,640 | A | 11/1999 | Baldwin et al. | |
| 5,990,629 | A | 11/1999 | Yamada et al. | |
| 6,034,659 | A | 3/2000 | Wald et al. | |
| 6,040,819 | A | 3/2000 | Someya | |
| 6,064,356 | A * | 5/2000 | Shigeta | 345/63 |
| 6,088,012 | A * | 7/2000 | Shigeta et al. | 345/63 |
| 6,091,203 | A | 7/2000 | Kawashima et al. | |
| 6,094,243 | A | 7/2000 | Yasunishi | |
| 6,144,364 | A | 11/2000 | Otobe et al. | |
| 6,157,356 | A | 12/2000 | Troutman | |
| 6,184,559 | B1 | 2/2001 | Hayakawa et al. | |
| 6,215,466 | B1 | 4/2001 | Yamazaki et al. | |
| 6,222,512 | B1 | 4/2001 | Tajima et al. | |
| 6,229,506 | B1 | 5/2001 | Dawson et al. | |
| 6,229,508 | B1 | 5/2001 | Kane | |
| 6,236,064 | B1 | 5/2001 | Mase et al. | |
| 6,246,179 | B1 | 6/2001 | Yamada | |
| 6,249,265 | B1 * | 6/2001 | Tajima et al. | 345/63 |
| 6,292,159 | B1 | 9/2001 | Someya et al. | |
| 6,310,588 | B1 | 10/2001 | Kawahara et al. | |
| 6,373,454 | B1 | 4/2002 | Knapp et al. | |
| 6,392,628 | B1 * | 5/2002 | Yamazaki et al. | 345/98 |
| 6,417,835 | B1 | 7/2002 | Otobe et al. | |
| 6,448,960 | B1 | 9/2002 | Shigeta | |
| 6,452,341 | B1 | 9/2002 | Yamauchi et al. | |
| 6,518,977 | B1 | 2/2003 | Naka et al. | |
| 6,542,138 | B1 | 4/2003 | Shannon et al. | |
| 6,563,480 | B1 | 5/2003 | Nakamura | |
| 6,563,486 | B2 | 5/2003 | Otobe et al. | |
| 6,617,644 | B1 | 9/2003 | Yamazaki et al. | |
| 6,689,492 | B1 | 2/2004 | Yamazaki et al. | |
| 6,759,999 | B1 | 7/2004 | Doyen | |
| 6,778,152 | B1 | 8/2004 | Huang | |
| 6,791,129 | B2 | 9/2004 | Inukai | |
| 6,794,675 | B1 | 9/2004 | Suzuki et al. | |
| 6,864,637 | B2 * | 3/2005 | Park et al. | 315/169.1 |
| 7,095,390 | B2 | 8/2006 | Otobe et al. | |
| 7,119,766 | B2 | 10/2006 | Otobe et al. | |
| 7,391,391 | B2 * | 6/2008 | Ohshima | 345/60 |
| 2001/0022565 | A1 | 9/2001 | Kimura | |
| 2001/0045923 | A1 | 11/2001 | Otobe et al. | |
| 2002/0018029 | A1 * | 2/2002 | Koyama | 345/39 |
| 2002/0047852 | A1 | 4/2002 | Inukai et al. | |
| 2002/0186208 | A1 * | 12/2002 | Feldman et al. | 345/173 |
| 2003/0057423 | A1 | 3/2003 | Shimoda et al. | |
| 2003/0058195 | A1 | 3/2003 | Adachi et al. | |
| 2003/0146910 | A1 * | 8/2003 | Tokunaga | 345/204 |
| 2004/0051142 | A1 | 3/2004 | Yamazaki et al. | |
| 2004/0061438 | A1 | 4/2004 | Yamazaki et al. | |
| 2004/0065902 | A1 | 4/2004 | Yamazaki et al. | |
| 2004/0263434 | A1 | 12/2004 | Otobe et al. | |
| 2005/0052351 | A1 | 3/2005 | Doyen et al. | |
| 2005/0212729 | A1 * | 9/2005 | Chung et al. | 345/76 |
| 2005/0219169 | A1 * | 10/2005 | Chung et al. | 345/76 |
| 2006/0139265 | A1 | 6/2006 | Kimura | |
| 2006/0164347 | A1 * | 7/2006 | Umezaki | 345/76 |

FOREIGN PATENT DOCUMENTS

| | | | |
|---|---|---|---|
| EP | 1058311 | B1 | 12/2000 |
| EP | 1058314 | A3 | 12/2000 |
| EP | 1111574 | A3 | 6/2001 |
| EP | 1148467 | A3 | 10/2001 |
| EP | 1150273 | A2 | 10/2001 |
| EP | 1184833 | A2 | 3/2002 |
| EP | 1187087 | A1 | 3/2002 |
| JP | 7049663 | A | 2/1995 |
| JP | 7175439 | A | 7/1995 |
| JP | 7271325 | A | 10/1995 |
| JP | 9034399 | A | 2/1997 |
| JP | 9172589 | A | 6/1997 |
| JP | 02639311 | B2 | 8/1997 |
| JP | 10031455 | A | 2/1998 |
| JP | 10171401 | A | 6/1998 |
| JP | 10307561 | | 11/1998 |
| JP | 11305726 | A | 11/1998 |
| JP | 11-065519 | A | 3/1999 |
| JP | 02903984 | B2 | 6/1999 |
| JP | 3075335 | U | 8/2000 |
| JP | 2001324958 | | 11/2001 |
| JP | 2002023697 | A | 1/2002 |
| JP | 03322809 | B2 | 9/2002 |
| JP | 2003-501700 | A | 1/2003 |
| JP | 03489884 | B2 | 1/2004 |
| JP | 03585369 | B2 | 11/2004 |
| WO | WO9960557 | A1 | 11/1999 |
| WO | WO9965012 | A3 | 12/1999 |
| WO | 00/75913 | A1 | 12/2000 |
| WO | WO0152229 | A1 | 7/2001 |

OTHER PUBLICATIONS

Search Report (Application No. 01121175.2) dated Jan. 23, 2004.
Office Action (Application No. 01121175.2) dated Nov. 25, 2004.
Office Action, Chinese Application No. 200710003982.X, dated Oct. 19, 2011, 13 pages with English translation.

* cited by examiner

FIG. 1

| Gray Scales \ Lighting Periods | SF1 | SF2 | SF3 | SF4 | SF5 | SF6 |
|---|---|---|---|---|---|---|
| | 4 | 4 | 4 | 16 | 1 | 2 |
| 0 | × | × | × | × | × | × |
| 1 | × | × | × | × | ○ | × |
| 2 | × | × | × | × | × | ○ |
| 3 | × | × | × | × | ○ | ○ |
| 4 | ○ | × | × | × | × | × |
| 5 | ○ | × | × | × | ○ | × |
| 6 | ○ | × | × | × | × | ○ |
| 7 | ○ | × | × | × | ○ | ○ |
| 8 | ○ | ○ | × | × | × | × |
| 9 | ○ | ○ | × | × | ○ | × |
| 10 | ○ | ○ | × | × | × | ○ |
| 11 | ○ | ○ | × | × | ○ | ○ |
| 12 | ○ | ○ | ○ | × | × | × |
| 13 | ○ | ○ | ○ | × | ○ | × |
| 14 | ○ | ○ | ○ | × | × | ○ |
| 15 | ○ | ○ | ○ | × | ○ | ○ |
| 16 | × | × | × | ○ | × | × |
| 17 | × | × | × | ○ | ○ | × |
| 18 | × | × | × | ○ | × | ○ |
| 19 | × | × | × | ○ | ○ | ○ |
| 20 | ○ | × | × | ○ | × | × |
| 21 | ○ | × | × | ○ | ○ | × |
| 22 | ○ | × | × | ○ | × | ○ |
| 23 | ○ | × | × | ○ | ○ | ○ |
| 24 | ○ | ○ | × | ○ | × | × |
| 25 | ○ | ○ | × | ○ | ○ | × |
| 26 | ○ | ○ | × | ○ | × | ○ |
| 27 | ○ | ○ | × | ○ | ○ | ○ |
| 28 | ○ | ○ | ○ | ○ | × | × |
| 29 | ○ | ○ | ○ | ○ | ○ | × |
| 30 | ○ | ○ | ○ | ○ | × | ○ |
| 31 | ○ | ○ | ○ | ○ | ○ | ○ |

○ : Lighting
× : non-Lighting

FIG. 2

Lighting Periods

| Gray Scales | SF1 | SF2 | SF3 | SF4 | SF7 | SF5 | SF6 |
|---|---|---|---|---|---|---|---|
| | 4 | 4 | 4 | 16 | 32 | 1 | 2 |
| 0 | × | × | × | × | × | × | × |
| 1 | × | × | × | × | × | ○ | × |
| 2 | × | × | × | × | × | × | ○ |
| 3 | × | × | × | × | × | ○ | ○ |
| 4 | ○ | × | × | × | × | × | × |
| 5 | ○ | × | × | × | × | ○ | × |
| 6 | ○ | × | × | × | × | × | ○ |
| 7 | ○ | × | × | × | × | ○ | ○ |
| 8 | ○ | ○ | × | × | × | × | × |
| 9 | ○ | ○ | × | × | × | ○ | × |
| 10 | ○ | ○ | × | × | × | × | ○ |
| 11 | ○ | ○ | × | × | × | ○ | ○ |
| 12 | ○ | ○ | ○ | × | × | × | × |
| 13 | ○ | ○ | ○ | × | × | ○ | × |
| 14 | ○ | ○ | ○ | × | × | × | ○ |
| 15 | ○ | ○ | ○ | × | × | ○ | ○ |
| 16 | × | × | × | ○ | × | × | × |
| 17 | × | × | × | ○ | × | ○ | × |
| 18 | × | × | × | ○ | × | × | ○ |
| 19 | × | × | × | ○ | × | ○ | ○ |
| 20 | ○ | × | × | ○ | × | × | × |
| 21 | ○ | × | × | ○ | × | ○ | × |
| 22 | ○ | × | × | ○ | × | × | ○ |
| 23 | ○ | × | × | ○ | × | ○ | ○ |
| 24 | ○ | ○ | × | ○ | × | × | × |
| 25 | ○ | ○ | × | ○ | × | ○ | × |
| 26 | ○ | ○ | × | ○ | × | × | ○ |
| 27 | ○ | ○ | × | ○ | × | ○ | ○ |
| 28 | ○ | ○ | ○ | ○ | × | × | × |
| 29 | ○ | ○ | ○ | ○ | × | ○ | × |
| 30 | ○ | ○ | ○ | ○ | × | × | ○ |
| 31 | ○ | ○ | ○ | ○ | × | ○ | ○ |
| 32 | × | × | × | × | ○ | × | × |
| 33 | × | × | × | × | ○ | ○ | × |
| 34 | × | × | × | × | ○ | × | ○ |
| 35 | × | × | × | × | ○ | ○ | ○ |
| 36 | ○ | × | × | × | ○ | × | × |
| 37 | ○ | × | × | × | ○ | ○ | × |
| 38 | ○ | × | × | × | ○ | × | ○ |
| 39 | ○ | × | × | × | ○ | ○ | ○ |
| 40 | ○ | ○ | × | × | ○ | × | × |
| 41 | ○ | ○ | × | × | ○ | ○ | × |
| 42 | ○ | ○ | × | × | ○ | × | ○ |
| 43 | ○ | ○ | × | × | ○ | ○ | ○ |
| 44 | ○ | ○ | ○ | × | ○ | × | × |
| 45 | ○ | ○ | ○ | × | ○ | ○ | × |
| 46 | ○ | ○ | ○ | × | ○ | × | ○ |
| 47 | ○ | ○ | ○ | × | ○ | ○ | ○ |
| 48 | × | × | × | ○ | ○ | × | × |
| 49 | × | × | × | ○ | ○ | ○ | × |
| 50 | × | × | × | ○ | ○ | × | ○ |
| 51 | × | × | × | ○ | ○ | ○ | ○ |
| 52 | ○ | × | × | ○ | ○ | × | × |
| 53 | ○ | × | × | ○ | ○ | ○ | × |
| 54 | ○ | × | × | ○ | ○ | × | ○ |
| 55 | ○ | × | × | ○ | ○ | ○ | ○ |
| 56 | ○ | ○ | × | ○ | ○ | × | × |
| 57 | ○ | ○ | × | ○ | ○ | ○ | × |
| 58 | ○ | ○ | × | ○ | ○ | × | ○ |
| 59 | ○ | ○ | × | ○ | ○ | ○ | ○ |
| 60 | ○ | ○ | ○ | ○ | ○ | × | × |
| 61 | ○ | ○ | ○ | ○ | ○ | ○ | × |
| 62 | ○ | ○ | ○ | ○ | ○ | × | ○ |
| 63 | ○ | ○ | ○ | ○ | ○ | ○ | ○ |

○ : Lighting
× : non-Lighting

FIG. 3

| Gray Scales \ Lighting Periods | SF1 | SF2 | SF3 | SF4a | SF4b | SF5 | SF6 |
|---|---|---|---|---|---|---|---|
| | 4 | 4 | 4 | 8 | 8 | 1 | 2 |
| 0 | × | × | × | × | × | × | × |
| 1 | × | × | × | × | × | ○ | × |
| 2 | × | × | × | × | × | × | ○ |
| 3 | × | × | × | × | × | ○ | ○ |
| 4 | ○ | × | × | × | × | × | × |
| 5 | ○ | × | × | × | × | ○ | × |
| 6 | ○ | × | × | × | × | × | ○ |
| 7 | ○ | × | × | × | × | ○ | ○ |
| 8 | ○ | ○ | × | × | × | × | × |
| 9 | ○ | ○ | × | × | × | ○ | × |
| 10 | ○ | ○ | × | × | × | × | ○ |
| 11 | ○ | ○ | × | × | × | ○ | ○ |
| 12 | ○ | ○ | ○ | × | × | × | × |
| 13 | ○ | ○ | ○ | × | × | ○ | × |
| 14 | ○ | ○ | ○ | × | × | × | ○ |
| 14′ | × | × | ○ | ○ | × | × | ○ |
| 15 | ○ | ○ | ○ | × | × | ○ | ○ |
| 15′ | × | × | ○ | ○ | × | ○ | ○ |
| 15′′ | × | × | ○ | × | ○ | ○ | ○ |
| 15a | × | ○ | × | ○ | × | ○ | ○ |
| 16 | × | × | × | ○ | ○ | × | × |
| 16′ | × | ○ | ○ | ○ | × | × | × |
| 17 | × | × | × | ○ | ○ | ○ | × |
| 18 | × | × | × | ○ | ○ | × | ○ |
| 19 | × | × | × | ○ | ○ | ○ | ○ |
| 20 | ○ | × | × | ○ | ○ | × | × |
| 21 | ○ | × | × | ○ | ○ | ○ | × |
| 22 | ○ | × | × | ○ | ○ | × | ○ |
| 23 | ○ | × | × | ○ | ○ | ○ | ○ |
| 24 | ○ | ○ | × | ○ | ○ | × | × |
| 25 | ○ | ○ | × | ○ | ○ | ○ | × |
| 26 | ○ | ○ | × | ○ | ○ | × | ○ |
| 27 | ○ | ○ | × | ○ | ○ | ○ | ○ |
| 28 | ○ | ○ | ○ | ○ | ○ | × | × |
| 29 | ○ | ○ | ○ | ○ | ○ | ○ | × |
| 30 | ○ | ○ | ○ | ○ | ○ | × | ○ |
| 31 | ○ | ○ | ○ | ○ | ○ | ○ | ○ |

○ : Lighting
× : non-Lighting

FIG. 4

| Gray Scales \ Lighting Periods | SF1 | SF2 | SF3 | SF4a | SF4b | SF4c | SF5 | SF6 |
|---|---|---|---|---|---|---|---|---|
| | 4 | 4 | 4 | 4 | 4 | 8 | 1 | 2 |
| 0 | × | × | × | × | × | × | × | × |
| 1 | × | × | × | × | × | × | ○ | × |
| 2 | × | × | × | × | × | × | × | ○ |
| 3 | × | × | × | × | × | × | ○ | ○ |
| 4 | ○ | × | × | × | × | × | × | × |
| 5 | ○ | × | × | × | × | × | ○ | × |
| 6 | ○ | × | × | × | × | × | × | ○ |
| 7 | ○ | × | × | × | × | × | ○ | ○ |
| 8 | ○ | ○ | × | × | × | × | × | × |
| 9 | ○ | ○ | × | × | × | × | ○ | × |
| 10 | ○ | ○ | × | × | × | × | × | ○ |
| 11 | ○ | ○ | × | × | × | × | ○ | ○ |
| 12 | ○ | ○ | ○ | × | × | × | × | × |
| 13 | ○ | ○ | ○ | × | × | × | ○ | × |
| 14 | ○ | ○ | ○ | × | × | × | × | ○ |
| 14′ | × | ○ | ○ | ○ | × | × | × | ○ |
| 15 | ○ | ○ | ○ | × | × | × | ○ | ○ |
| 15′ | × | × | × | × | ○ | ○ | ○ | ○ |
| 15′′ | × | × | × | ○ | × | ○ | ○ | ○ |
| 15a | × | × | ○ | × | × | ○ | ○ | ○ |
| 15b | × | × | ○ | ○ | ○ | × | ○ | ○ |
| 15c | × | ○ | ○ | ○ | × | × | ○ | ○ |
| 16 | × | × | × | ○ | ○ | ○ | × | × |
| 16′ | × | × | ○ | × | ○ | ○ | × | × |
| 17 | × | × | × | ○ | ○ | ○ | ○ | × |
| 18 | × | × | × | ○ | ○ | ○ | × | ○ |
| 19 | × | × | × | ○ | ○ | ○ | ○ | ○ |
| 20 | ○ | × | × | ○ | ○ | ○ | × | × |
| 21 | ○ | × | × | ○ | ○ | ○ | ○ | × |
| 22 | ○ | × | × | ○ | ○ | ○ | × | ○ |
| 23 | ○ | × | × | ○ | ○ | ○ | ○ | ○ |
| 24 | ○ | ○ | × | ○ | ○ | ○ | × | × |
| 25 | ○ | ○ | × | ○ | ○ | ○ | ○ | × |
| 26 | ○ | ○ | × | ○ | ○ | ○ | × | ○ |
| 27 | ○ | ○ | × | ○ | ○ | ○ | ○ | ○ |
| 28 | ○ | ○ | ○ | ○ | ○ | ○ | × | × |
| 29 | ○ | ○ | ○ | ○ | ○ | ○ | ○ | × |
| 30 | ○ | ○ | ○ | ○ | ○ | ○ | × | ○ |
| 31 | ○ | ○ | ○ | ○ | ○ | ○ | ○ | ○ |

○ : Lighting
× : non-Lighting

FIG. 5

| Gray Scales \ Lighting Periods | SF1 | SF2 | SF3 | SF4 | SF5 | SF6 |
|---|---|---|---|---|---|---|
| | 2 | 2 | 2 | 8 | 16 | 1 |
| 0 | × | × | × | × | × | × |
| 1 | × | × | × | × | × | ○ |
| 2 | ○ | × | × | × | × | × |
| 3 | ○ | × | × | × | × | ○ |
| 4 | ○ | ○ | × | × | × | × |
| 5 | ○ | ○ | × | × | × | ○ |
| 6 | ○ | ○ | ○ | × | × | × |
| 7 | ○ | ○ | ○ | × | × | ○ |
| 8 | × | × | × | ○ | × | × |
| 9 | × | × | × | ○ | × | ○ |
| 10 | ○ | × | × | ○ | × | × |
| 11 | ○ | × | × | ○ | × | ○ |
| 12 | ○ | ○ | × | ○ | × | × |
| 13 | ○ | ○ | × | ○ | × | ○ |
| 14 | ○ | ○ | ○ | ○ | × | × |
| 15 | ○ | ○ | ○ | ○ | × | ○ |
| 16 | × | × | × | × | ○ | × |
| 17 | × | × | × | × | ○ | ○ |
| 18 | ○ | × | × | × | ○ | × |
| 19 | ○ | × | × | × | ○ | ○ |
| 20 | ○ | ○ | × | × | ○ | × |
| 21 | ○ | ○ | × | × | ○ | ○ |
| 22 | ○ | ○ | ○ | × | ○ | × |
| 23 | ○ | ○ | ○ | × | ○ | ○ |
| 24 | × | × | × | ○ | ○ | × |
| 25 | × | × | × | ○ | ○ | ○ |
| 26 | ○ | × | × | ○ | ○ | × |
| 27 | ○ | × | × | ○ | ○ | ○ |
| 28 | ○ | ○ | × | ○ | ○ | × |
| 29 | ○ | ○ | × | ○ | ○ | ○ |
| 30 | ○ | ○ | ○ | ○ | ○ | × |
| 31 | ○ | ○ | ○ | ○ | ○ | ○ |

○ : Lighting
× : non-Lighting

FIG. 6

| Gray Scales \ Lighting Periods | SF1 | SF2 | SF3 | SF4 | SF5a | SF5b | SF6 |
|---|---|---|---|---|---|---|---|
| | 2 | 2 | 2 | 8 | 8 | 8 | 1 |
| 0 | × | × | × | × | × | × | × |
| 1 | × | × | × | × | × | × | ○ |
| 2 | ○ | × | × | × | × | × | × |
| 3 | ○ | × | × | × | × | × | ○ |
| 4 | ○ | ○ | × | × | × | × | × |
| 5 | ○ | ○ | × | × | × | × | ○ |
| 6 | ○ | ○ | ○ | × | × | × | × |
| 7 | ○ | ○ | ○ | × | × | × | ○ |
| 8 | × | × | × | ○ | × | × | × |
| 9 | × | × | × | ○ | × | × | ○ |
| 10 | ○ | × | × | ○ | × | × | × |
| 11 | ○ | × | × | ○ | × | × | ○ |
| 12 | ○ | ○ | × | ○ | × | × | × |
| 13 | ○ | ○ | × | ○ | × | × | ○ |
| 14 | ○ | ○ | ○ | ○ | × | × | × |
| 15 | ○ | ○ | ○ | ○ | × | × | ○ |
| 15′ | ○ | ○ | ○ | × | ○ | × | ○ |
| 16 | × | × | × | × | ○ | ○ | × |
| 17 | × | × | × | × | ○ | ○ | ○ |
| 18 | ○ | × | × | × | ○ | ○ | × |
| 19 | ○ | × | × | × | ○ | ○ | ○ |
| 20 | ○ | ○ | × | × | ○ | ○ | × |
| 21 | ○ | ○ | × | × | ○ | ○ | ○ |
| 22 | ○ | ○ | ○ | × | ○ | ○ | × |
| 23 | ○ | ○ | ○ | × | ○ | ○ | ○ |
| 24 | × | × | × | ○ | ○ | ○ | × |
| 25 | × | × | × | ○ | ○ | ○ | ○ |
| 26 | ○ | × | × | ○ | ○ | ○ | × |
| 27 | ○ | × | × | ○ | ○ | ○ | ○ |
| 28 | ○ | ○ | × | ○ | ○ | ○ | × |
| 29 | ○ | ○ | × | ○ | ○ | ○ | ○ |
| 30 | ○ | ○ | ○ | ○ | ○ | ○ | × |
| 31 | ○ | ○ | ○ | ○ | ○ | ○ | ○ |

○ : Lighting
× : non-Lighting

FIG. 7

| Gray Scales \ Lighting Periods | SF1 | SF2 | SF3 | SF4 | SF5 | SF6 | SF7 | SF8 | SF9 |
|---|---|---|---|---|---|---|---|---|---|
| | 1 | 2 | 4 | 4 | 4 | 4 | 4 | 4 | 4 |
| 0 | × | × | × | × | × | × | × | × | × |
| 1 | ○ | × | × | × | × | × | × | × | × |
| 2 | × | ○ | × | × | × | × | × | × | × |
| 3 | ○ | ○ | × | × | × | × | × | × | × |
| 4 | × | × | ○ | × | × | × | × | × | × |
| 5 | ○ | × | × | ○ | × | × | × | × | × |
| 6 | × | ○ | × | ○ | × | × | × | × | × |
| 7 | ○ | ○ | × | ○ | × | × | × | × | × |
| 8 | × | × | ○ | ○ | × | × | × | × | × |
| 9 | ○ | × | × | ○ | ○ | × | × | × | × |
| 10 | × | ○ | × | ○ | ○ | × | × | × | × |
| 11 | ○ | ○ | × | ○ | ○ | × | × | × | × |
| 12 | × | × | ○ | ○ | ○ | × | × | × | × |
| 13 | ○ | × | × | ○ | ○ | ○ | × | × | × |
| 14 | × | ○ | × | ○ | ○ | ○ | × | × | × |
| 15 | ○ | ○ | × | ○ | ○ | ○ | × | × | × |
| 16 | × | × | ○ | ○ | ○ | ○ | × | × | × |
| 17 | ○ | × | × | ○ | ○ | ○ | ○ | × | × |
| 18 | × | ○ | × | ○ | ○ | ○ | ○ | × | × |
| 19 | ○ | ○ | × | ○ | ○ | ○ | ○ | × | × |
| 20 | × | × | ○ | ○ | ○ | ○ | ○ | × | × |
| 21 | ○ | × | × | ○ | ○ | ○ | ○ | ○ | × |
| 22 | × | ○ | × | ○ | ○ | ○ | ○ | ○ | × |
| 23 | ○ | ○ | × | ○ | ○ | ○ | ○ | ○ | × |
| 24 | × | × | ○ | ○ | ○ | ○ | ○ | ○ | × |
| 25 | ○ | × | × | ○ | ○ | ○ | ○ | ○ | ○ |
| 26 | × | ○ | × | ○ | ○ | ○ | ○ | ○ | ○ |
| 27 | ○ | ○ | × | ○ | ○ | ○ | ○ | ○ | ○ |
| 28 | × | × | ○ | ○ | ○ | ○ | ○ | ○ | ○ |
| 29 | ○ | × | ○ | ○ | ○ | ○ | ○ | ○ | ○ |
| 30 | × | ○ | ○ | ○ | ○ | ○ | ○ | ○ | ○ |
| 31 | ○ | ○ | ○ | ○ | ○ | ○ | ○ | ○ | ○ |

○ : Lighting
× : non-Lighting

FIG. 8

| Gray Scales \ Lighting Periods | SF1 | SF2a | SF2b | SF3 | SF4 | SF5 | SF6 | SF7 | SF8 | SF9 |
|---|---|---|---|---|---|---|---|---|---|---|
| | 1 | 1 | 1 | 4 | 4 | 4 | 4 | 4 | 4 | 4 |
| 0 | × | × | × | × | × | × | × | × | × | × |
| 1 | ○ | × | × | × | × | × | × | × | × | × |
| 2 | ○ | ○ | × | × | × | × | × | × | × | × |
| 3 | ○ | ○ | ○ | × | × | × | × | × | × | × |
| 4 | × | × | × | ○ | × | × | × | × | × | × |
| 5 | ○ | × | × | × | ○ | × | × | × | × | × |
| 6 | × | ○ | × | × | ○ | × | × | × | × | × |
| 7 | ○ | ○ | ○ | × | ○ | × | × | × | × | × |
| 8 | × | × | × | ○ | ○ | × | × | × | × | × |
| 9 | ○ | × | × | × | ○ | ○ | × | × | × | × |
| 10 | ○ | ○ | × | × | ○ | ○ | × | × | × | × |
| 11 | ○ | ○ | ○ | × | ○ | ○ | × | × | × | × |
| 12 | × | × | × | ○ | ○ | ○ | × | × | × | × |
| 13 | ○ | × | × | × | ○ | ○ | ○ | × | × | × |
| 14 | ○ | ○ | × | × | ○ | ○ | ○ | × | × | × |
| 15 | ○ | ○ | ○ | × | ○ | ○ | ○ | × | × | × |
| 16 | × | × | × | ○ | ○ | ○ | ○ | × | × | × |
| 17 | ○ | × | × | × | ○ | ○ | ○ | ○ | × | × |
| 18 | ○ | ○ | × | × | ○ | ○ | ○ | ○ | × | × |
| 19 | ○ | ○ | ○ | × | ○ | ○ | ○ | ○ | × | × |
| 20 | × | × | × | ○ | ○ | ○ | ○ | ○ | × | × |
| 21 | ○ | × | × | × | ○ | ○ | ○ | ○ | ○ | × |
| 22 | ○ | ○ | × | × | ○ | ○ | ○ | ○ | ○ | × |
| 23 | ○ | ○ | ○ | × | ○ | ○ | ○ | ○ | ○ | × |
| 24 | × | × | × | ○ | ○ | ○ | ○ | ○ | ○ | × |
| 25 | ○ | × | × | × | ○ | ○ | ○ | ○ | ○ | ○ |
| 26 | ○ | ○ | × | × | ○ | ○ | ○ | ○ | ○ | ○ |
| 27 | ○ | ○ | ○ | × | ○ | ○ | ○ | ○ | ○ | ○ |
| 28 | × | × | × | ○ | ○ | ○ | ○ | ○ | ○ | ○ |
| 29 | ○ | × | × | ○ | ○ | ○ | ○ | ○ | ○ | ○ |
| 30 | ○ | ○ | × | ○ | ○ | ○ | ○ | ○ | ○ | ○ |
| 31 | ○ | ○ | ○ | ○ | ○ | ○ | ○ | ○ | ○ | ○ |

○ : Lighting
× : non-Lighting

FIG. 9

| Gray Scales \ Lighting Periods | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 8 | 8 | 8 | 8 | 8 | 8 | 8 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| 4 | × | × | ○ | × | × | × | × | × | × | × |
| 5 | ○ | × | ○ | × | × | × | × | × | × | × |
| 6 | × | ○ | ○ | × | × | × | × | × | × | × |
| 7 | ○ | ○ | ○ | × | × | × | × | × | × | × |
| 8 | × | × | × | ○ | × | × | × | × | × | × |
| 9 | ○ | × | × | × | ○ | × | × | × | × | × |
| 10 | × | ○ | × | × | ○ | × | × | × | × | × |
| 11 | ○ | ○ | × | × | ○ | × | × | × | × | × |
| 12 | × | × | ○ | × | ○ | × | × | × | × | × |
| 13 | ○ | × | ○ | × | ○ | × | × | × | × | × |
| 14 | × | ○ | ○ | × | ○ | × | × | × | × | × |
| 15 | ○ | ○ | ○ | × | ○ | × | × | × | × | × |
| 16 | × | × | × | ○ | ○ | × | × | × | × | × |
| 17 | ○ | × | × | × | ○ | ○ | × | × | × | × |
| 18 | × | ○ | × | × | ○ | ○ | × | × | × | × |
| 19 | ○ | ○ | × | × | ○ | ○ | × | × | × | × |
| 20 | × | × | ○ | × | ○ | ○ | × | × | × | × |
| 21 | ○ | × | ○ | × | ○ | ○ | × | × | × | × |
| 22 | × | ○ | ○ | × | ○ | ○ | × | × | × | × |
| 23 | ○ | ○ | ○ | × | ○ | ○ | × | × | × | × |
| 24 | × | × | × | ○ | ○ | ○ | × | × | × | × |
| 25 | ○ | × | × | × | ○ | ○ | ○ | × | × | × |
| 26 | × | ○ | × | × | ○ | ○ | ○ | × | × | × |
| 27 | ○ | ○ | × | × | ○ | ○ | ○ | × | × | × |
| 28 | × | × | ○ | × | ○ | ○ | ○ | × | × | × |
| 29 | ○ | × | ○ | × | ○ | ○ | ○ | × | × | × |
| 30 | × | ○ | ○ | × | ○ | ○ | ○ | × | × | × |
| 31 | ○ | ○ | ○ | × | ○ | ○ | ○ | × | × | × |
| 32 | × | × | × | ○ | ○ | ○ | ○ | × | × | × |
| 33 | ○ | × | × | × | ○ | ○ | ○ | ○ | × | × |
| 34 | × | ○ | × | × | ○ | ○ | ○ | ○ | × | × |
| 35 | ○ | ○ | × | × | ○ | ○ | ○ | ○ | × | × |
| 36 | × | × | ○ | × | ○ | ○ | ○ | ○ | × | × |
| 37 | ○ | × | ○ | × | ○ | ○ | ○ | ○ | × | × |
| 38 | × | ○ | ○ | × | ○ | ○ | ○ | ○ | × | × |
| 39 | ○ | ○ | ○ | × | ○ | ○ | ○ | ○ | × | × |
| 40 | × | × | × | ○ | ○ | ○ | ○ | ○ | × | × |
| 41 | ○ | × | × | × | ○ | ○ | ○ | ○ | ○ | × |
| 42 | × | ○ | × | × | ○ | ○ | ○ | ○ | ○ | × |
| 43 | ○ | ○ | × | × | ○ | ○ | ○ | ○ | ○ | × |
| 44 | × | × | ○ | × | ○ | ○ | ○ | ○ | ○ | × |
| 45 | ○ | × | ○ | × | ○ | ○ | ○ | ○ | ○ | × |
| 46 | × | ○ | ○ | × | ○ | ○ | ○ | ○ | ○ | × |
| 47 | ○ | ○ | ○ | × | ○ | ○ | ○ | ○ | ○ | × |
| 48 | × | × | × | ○ | ○ | ○ | ○ | ○ | ○ | × |
| 49 | ○ | × | × | × | ○ | ○ | ○ | ○ | ○ | ○ |
| 50 | × | ○ | × | × | ○ | ○ | ○ | ○ | ○ | ○ |
| 51 | ○ | ○ | × | × | ○ | ○ | ○ | ○ | ○ | ○ |
| 52 | × | × | ○ | × | ○ | ○ | ○ | ○ | ○ | ○ |
| 53 | ○ | × | ○ | × | ○ | ○ | ○ | ○ | ○ | ○ |
| 54 | × | ○ | ○ | × | ○ | ○ | ○ | ○ | ○ | ○ |
| 55 | ○ | ○ | ○ | × | ○ | ○ | ○ | ○ | ○ | ○ |
| 56 | × | × | × | ○ | ○ | ○ | ○ | ○ | ○ | ○ |
| 57 | ○ | × | × | ○ | ○ | ○ | ○ | ○ | ○ | ○ |
| 58 | × | ○ | × | ○ | ○ | ○ | ○ | ○ | ○ | ○ |
| 59 | ○ | ○ | × | ○ | ○ | ○ | ○ | ○ | ○ | ○ |
| 60 | × | × | ○ | ○ | ○ | ○ | ○ | ○ | ○ | ○ |
| 61 | ○ | × | ○ | ○ | ○ | ○ | ○ | ○ | ○ | ○ |
| 62 | × | ○ | ○ | ○ | ○ | ○ | ○ | ○ | ○ | ○ |
| 63 | ○ | ○ | ○ | ○ | ○ | ○ | ○ | ○ | ○ | ○ |

○ : Lighting
× : non-Lighting

FIG. 10

| Gray Scales \ Lighting Periods | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 8 | 8 | 8 | 8 | 8 | 8 | 8 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| 4 | × | × | ○ | × | × | × | × | × | × | × |
| 5 | ○ | × | ○ | × | × | × | × | × | × | × |
| 6 | × | ○ | ○ | × | × | × | × | × | × | × |
| 7 | ○ | ○ | ○ | × | × | × | × | × | × | × |
| 8 | × | × | × | ○ | × | × | × | × | × | × |
| 9 | ○ | × | × | ○ | × | × | × | × | × | × |
| 10 | × | ○ | × | × | ○ | × | × | × | × | × |
| 11 | ○ | ○ | × | × | ○ | × | × | × | × | × |
| 12 | × | × | ○ | × | ○ | × | × | × | × | × |
| 13 | ○ | × | ○ | × | ○ | × | × | × | × | × |
| 14 | × | ○ | ○ | × | ○ | × | × | × | × | × |
| 15 | ○ | ○ | ○ | × | ○ | × | × | × | × | × |
| 16 | × | × | × | ○ | ○ | × | × | × | × | × |
| 17 | ○ | × | × | ○ | ○ | × | × | × | × | × |
| 18 | × | ○ | × | × | ○ | ○ | × | × | × | × |
| 19 | ○ | ○ | × | × | ○ | ○ | × | × | × | × |
| 20 | × | × | ○ | × | ○ | ○ | × | × | × | × |
| 21 | ○ | × | ○ | × | ○ | ○ | × | × | × | × |
| 22 | × | ○ | ○ | × | ○ | ○ | × | × | × | × |
| 23 | ○ | ○ | ○ | × | ○ | ○ | × | × | × | × |
| 24 | × | × | × | ○ | ○ | ○ | × | × | × | × |
| 25 | ○ | × | × | ○ | ○ | ○ | × | × | × | × |
| 26 | × | ○ | × | × | ○ | ○ | ○ | × | × | × |
| 27 | ○ | ○ | × | × | ○ | ○ | ○ | × | × | × |
| 28 | × | × | ○ | × | ○ | ○ | ○ | × | × | × |
| 29 | ○ | × | ○ | × | ○ | ○ | ○ | × | × | × |
| 30 | × | ○ | ○ | × | ○ | ○ | ○ | × | × | × |
| 31 | ○ | ○ | ○ | × | ○ | ○ | ○ | × | × | × |
| 32 | × | × | × | ○ | ○ | ○ | ○ | × | × | × |
| 33 | ○ | × | × | ○ | ○ | ○ | ○ | × | × | × |
| 34 | × | ○ | × | × | ○ | ○ | ○ | ○ | × | × |
| 35 | ○ | ○ | × | × | ○ | ○ | ○ | ○ | × | × |
| 36 | × | × | ○ | × | ○ | ○ | ○ | ○ | × | × |
| 37 | ○ | × | ○ | × | ○ | ○ | ○ | ○ | × | × |
| 38 | × | ○ | ○ | × | ○ | ○ | ○ | ○ | × | × |
| 39 | ○ | ○ | ○ | × | ○ | ○ | ○ | ○ | × | × |
| 40 | × | × | × | ○ | ○ | ○ | ○ | ○ | × | × |
| 41 | ○ | × | × | ○ | ○ | ○ | ○ | ○ | × | × |
| 42 | × | ○ | × | × | ○ | ○ | ○ | ○ | ○ | × |
| 43 | ○ | ○ | × | × | ○ | ○ | ○ | ○ | ○ | × |
| 44 | × | × | ○ | × | ○ | ○ | ○ | ○ | ○ | × |
| 45 | ○ | × | ○ | × | ○ | ○ | ○ | ○ | ○ | × |
| 46 | × | ○ | ○ | × | ○ | ○ | ○ | ○ | ○ | × |
| 47 | ○ | ○ | ○ | × | ○ | ○ | ○ | ○ | ○ | × |
| 48 | × | × | × | ○ | ○ | ○ | ○ | ○ | ○ | × |
| 49 | ○ | × | × | ○ | ○ | ○ | ○ | ○ | ○ | × |
| 50 | × | ○ | × | × | ○ | ○ | ○ | ○ | ○ | ○ |
| 51 | ○ | ○ | × | × | ○ | ○ | ○ | ○ | ○ | ○ |
| 52 | × | × | ○ | × | ○ | ○ | ○ | ○ | ○ | ○ |
| 53 | ○ | × | ○ | × | ○ | ○ | ○ | ○ | ○ | ○ |
| 54 | × | ○ | ○ | × | ○ | ○ | ○ | ○ | ○ | ○ |
| 55 | ○ | ○ | ○ | × | ○ | ○ | ○ | ○ | ○ | ○ |
| 56 | × | × | × | ○ | ○ | ○ | ○ | ○ | ○ | ○ |
| 57 | ○ | × | × | ○ | ○ | ○ | ○ | ○ | ○ | ○ |
| 58 | × | ○ | × | ○ | ○ | ○ | ○ | ○ | ○ | ○ |
| 59 | ○ | ○ | × | ○ | ○ | ○ | ○ | ○ | ○ | ○ |
| 60 | × | × | ○ | ○ | ○ | ○ | ○ | ○ | ○ | ○ |
| 61 | ○ | × | ○ | ○ | ○ | ○ | ○ | ○ | ○ | ○ |
| 62 | × | ○ | ○ | ○ | ○ | ○ | ○ | ○ | ○ | ○ |
| 63 | ○ | ○ | ○ | ○ | ○ | ○ | ○ | ○ | ○ | ○ |

○ : Lighting
× : non-Lighting

FIG. 11

| Gray Scales \ Lighting Periods | SF1 | SF2 | SF3 | SF4 | SF5 | SF6 |
|---|---|---|---|---|---|---|
| | 1 | 2 | 16 | 16 | 16 | 16 |
| 0 | × | × | × | × | × | × |
| 1 | ○ | × | × | × | × | × |
| 2 | × | ○ | × | × | × | × |
| 3 | ○ | ○ | × | × | × | × |
| 4 | × | × | ○ | × | × | × |
| 5 | ○ | × | ○ | × | × | × |
| 6 | × | ○ | ○ | × | × | × |
| 7 | ○ | ○ | ○ | × | × | × |
| 8 | × | × | ○ | × | × | × |
| 9 | ○ | × | ○ | × | × | × |
| 10 | × | ○ | ○ | × | × | × |
| 11 | ○ | ○ | ○ | × | × | × |
| 12 | × | × | ○ | × | × | × |
| 13 | ○ | × | ○ | × | × | × |
| 14 | × | ○ | ○ | × | × | × |
| 15 | ○ | ○ | ○ | × | × | × |
| 16 | × | × | ○ | × | × | × |
| 17 | ○ | × | ○ | × | × | × |
| 18 | × | ○ | ○ | × | × | × |
| 19 | ○ | ○ | ○ | × | × | × |
| 20 | × | × | ○ | ○ | × | × |
| 21 | ○ | × | ○ | ○ | × | × |
| 22 | × | ○ | ○ | ○ | × | × |
| 23 | ○ | ○ | ○ | ○ | × | × |
| 24 | × | × | ○ | ○ | × | × |
| 25 | ○ | × | ○ | ○ | × | × |
| 26 | × | ○ | ○ | ○ | × | × |
| 27 | ○ | ○ | ○ | ○ | × | × |
| 28 | × | × | ○ | ○ | × | × |
| 29 | ○ | × | ○ | ○ | × | × |
| 30 | × | ○ | ○ | ○ | × | × |
| 31 | ○ | ○ | ○ | ○ | × | × |
| 32 | × | × | ○ | ○ | × | × |
| 33 | ○ | × | ○ | ○ | × | × |
| 34 | × | ○ | ○ | ○ | × | × |
| 35 | ○ | ○ | ○ | ○ | × | × |
| 36 | × | × | ○ | ○ | ○ | × |
| 37 | ○ | × | ○ | ○ | ○ | × |
| 38 | × | ○ | ○ | ○ | ○ | × |
| 39 | ○ | ○ | ○ | ○ | ○ | × |
| 40 | × | × | ○ | ○ | ○ | × |
| 41 | ○ | × | ○ | ○ | ○ | × |
| 42 | × | ○ | ○ | ○ | ○ | × |
| 43 | ○ | ○ | ○ | ○ | ○ | × |
| 44 | × | × | ○ | ○ | ○ | × |
| 45 | ○ | × | ○ | ○ | ○ | × |
| 46 | × | ○ | ○ | ○ | ○ | × |
| 47 | ○ | ○ | ○ | ○ | ○ | × |
| 48 | × | × | ○ | ○ | ○ | × |
| 49 | ○ | × | ○ | ○ | ○ | × |
| 50 | × | ○ | ○ | ○ | ○ | × |
| 51 | ○ | ○ | ○ | ○ | ○ | × |
| 52 | × | × | ○ | ○ | ○ | ○ |
| 53 | ○ | × | ○ | ○ | ○ | ○ |
| 54 | × | ○ | ○ | ○ | ○ | ○ |
| 55 | ○ | ○ | ○ | ○ | ○ | ○ |
| 56 | × | × | ○ | ○ | ○ | ○ |
| 57 | ○ | × | ○ | ○ | ○ | ○ |
| 58 | × | ○ | ○ | ○ | ○ | ○ |
| 59 | ○ | ○ | ○ | ○ | ○ | ○ |
| 60 | × | × | ○ | ○ | ○ | ○ |
| 61 | ○ | × | ○ | ○ | ○ | ○ |
| 62 | × | ○ | ○ | ○ | ○ | ○ |
| 63 | ○ | ○ | ○ | ○ | ○ | ○ |

○ : Lighting
× : non-Lighting

FIG. 12

| Gray Scales \ Lighting Periods | SF1 | SF2 | SF3 | SF4 | SF5 | SF6 | SF7 | SF8 | SF9 | SF10 |
|---|---|---|---|---|---|---|---|---|---|---|
| | 1 | 2 | 8 | 8 | 8 | 8 | 8 | 8 | 8 | 8 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| 4 | × | × | ○ | × | × | × | × | × | × | × |
| 5 | ○ | × | ○ | × | × | × | × | × | × | × |
| 6 | × | ○ | ○ | × | × | × | × | × | × | × |
| 7 | ○ | ○ | ○ | × | × | × | × | × | × | × |
| 8 | × | × | ○ | × | × | × | × | × | × | × |
| 9 | ○ | × | ○ | × | × | × | × | × | × | × |
| 10 | × | ○ | ○ | × | × | × | × | × | × | × |
| 11 | ○ | ○ | ○ | × | × | × | × | × | × | × |
| 12 | × | × | ○ | ○ | × | × | × | × | × | × |
| 13 | ○ | × | ○ | ○ | × | × | × | × | × | × |
| 14 | × | ○ | ○ | ○ | × | × | × | × | × | × |
| 15 | ○ | ○ | ○ | ○ | × | × | × | × | × | × |
| 16 | × | × | ○ | ○ | × | × | × | × | × | × |
| 17 | ○ | × | ○ | ○ | × | × | × | × | × | × |
| 18 | × | ○ | ○ | ○ | × | × | × | × | × | × |
| 19 | ○ | ○ | ○ | ○ | × | × | × | × | × | × |
| 20 | × | × | ○ | ○ | ○ | × | × | × | × | × |
| 21 | ○ | × | ○ | ○ | ○ | × | × | × | × | × |
| 22 | × | ○ | ○ | ○ | ○ | × | × | × | × | × |
| 23 | ○ | ○ | ○ | ○ | ○ | × | × | × | × | × |
| 24 | × | × | ○ | ○ | ○ | × | × | × | × | × |
| 25 | ○ | × | ○ | ○ | ○ | × | × | × | × | × |
| 26 | × | ○ | ○ | ○ | ○ | × | × | × | × | × |
| 27 | ○ | ○ | ○ | ○ | ○ | × | × | × | × | × |
| 28 | × | × | ○ | ○ | ○ | ○ | × | × | × | × |
| 29 | ○ | × | ○ | ○ | ○ | ○ | × | × | × | × |
| 30 | × | ○ | ○ | ○ | ○ | ○ | × | × | × | × |
| 31 | ○ | ○ | ○ | ○ | ○ | ○ | × | × | × | × |
| 32 | × | × | ○ | ○ | ○ | ○ | × | × | × | × |
| 33 | ○ | × | ○ | ○ | ○ | ○ | × | × | × | × |
| 34 | × | ○ | ○ | ○ | ○ | ○ | × | × | × | × |
| 35 | ○ | ○ | ○ | ○ | ○ | ○ | × | × | × | × |
| 36 | × | × | ○ | ○ | ○ | ○ | ○ | × | × | × |
| 37 | ○ | × | ○ | ○ | ○ | ○ | ○ | × | × | × |
| 38 | × | ○ | ○ | ○ | ○ | ○ | ○ | × | × | × |
| 39 | ○ | ○ | ○ | ○ | ○ | ○ | ○ | × | × | × |
| 40 | × | × | ○ | ○ | ○ | ○ | ○ | × | × | × |
| 41 | ○ | × | ○ | ○ | ○ | ○ | ○ | × | × | × |
| 42 | × | ○ | ○ | ○ | ○ | ○ | ○ | × | × | × |
| 43 | ○ | ○ | ○ | ○ | ○ | ○ | ○ | × | × | × |
| 44 | × | × | ○ | ○ | ○ | ○ | ○ | ○ | × | × |
| 45 | ○ | × | ○ | ○ | ○ | ○ | ○ | ○ | × | × |
| 46 | × | ○ | ○ | ○ | ○ | ○ | ○ | ○ | × | × |
| 47 | ○ | ○ | ○ | ○ | ○ | ○ | ○ | ○ | × | × |
| 48 | × | × | ○ | ○ | ○ | ○ | ○ | ○ | × | × |
| 49 | ○ | × | ○ | ○ | ○ | ○ | ○ | ○ | × | × |
| 50 | × | ○ | ○ | ○ | ○ | ○ | ○ | ○ | × | × |
| 51 | ○ | ○ | ○ | ○ | ○ | ○ | ○ | ○ | × | × |
| 52 | × | × | ○ | ○ | ○ | ○ | ○ | ○ | ○ | × |
| 53 | ○ | × | ○ | ○ | ○ | ○ | ○ | ○ | ○ | × |
| 54 | × | ○ | ○ | ○ | ○ | ○ | ○ | ○ | ○ | × |
| 55 | ○ | ○ | ○ | ○ | ○ | ○ | ○ | ○ | ○ | × |
| 56 | × | × | ○ | ○ | ○ | ○ | ○ | ○ | ○ | × |
| 57 | ○ | × | ○ | ○ | ○ | ○ | ○ | ○ | ○ | × |
| 58 | × | ○ | ○ | ○ | ○ | ○ | ○ | ○ | ○ | × |
| 59 | ○ | ○ | ○ | ○ | ○ | ○ | ○ | ○ | ○ | × |
| 60 | × | × | ○ | ○ | ○ | ○ | ○ | ○ | ○ | ○ |
| 61 | ○ | × | ○ | ○ | ○ | ○ | ○ | ○ | ○ | ○ |
| 62 | × | ○ | ○ | ○ | ○ | ○ | ○ | ○ | ○ | ○ |
| 63 | ○ | ○ | ○ | ○ | ○ | ○ | ○ | ○ | ○ | ○ |

○ : Lighting
× : non-Lighting

FIG. 13

| Gray Scales \ Lighting Periods | SF1 | SF2 | SF3 | SF4 | SF5 | SF6 | SF7 | SF7 | SF9 |
|---|---|---|---|---|---|---|---|---|---|
| | 1 | 8 | 8 | 8 | 8 | 8 | 8 | 8 | 8 |
| 0 | × | × | × | × | × | × | × | × | × |
| 1 | ○ | × | × | × | × | × | × | × | × |
| 2 | × | ○ | × | × | × | × | × | × | × |
| 3 | ○ | ○ | × | × | × | × | × | × | × |
| 4 | × | ○ | × | × | × | × | × | × | × |
| 5 | ○ | ○ | × | × | × | × | × | × | × |
| 6 | × | ○ | × | × | × | × | × | × | × |
| 7 | ○ | ○ | × | × | × | × | × | × | × |
| 8 | × | ○ | × | × | × | × | × | × | × |
| 9 | ○ | ○ | × | × | × | × | × | × | × |
| 10 | × | ○ | ○ | × | × | × | × | × | × |
| 11 | ○ | ○ | ○ | × | × | × | × | × | × |
| 12 | × | ○ | ○ | × | × | × | × | × | × |
| 13 | ○ | ○ | ○ | × | × | × | × | × | × |
| 14 | × | ○ | ○ | × | × | × | × | × | × |
| 15 | ○ | ○ | ○ | × | × | × | × | × | × |
| 16 | × | ○ | ○ | × | × | × | × | × | × |
| 17 | ○ | ○ | ○ | × | × | × | × | × | × |
| 18 | × | ○ | ○ | ○ | × | × | × | × | × |
| 19 | ○ | ○ | ○ | ○ | × | × | × | × | × |
| 20 | × | ○ | ○ | ○ | × | × | × | × | × |
| 21 | ○ | ○ | ○ | ○ | × | × | × | × | × |
| 22 | × | ○ | ○ | ○ | × | × | × | × | × |
| 23 | ○ | ○ | ○ | ○ | × | × | × | × | × |
| 24 | × | ○ | ○ | ○ | × | × | × | × | × |
| 25 | ○ | ○ | ○ | ○ | × | × | × | × | × |
| 26 | × | ○ | ○ | ○ | ○ | × | × | × | × |
| 27 | ○ | ○ | ○ | ○ | ○ | × | × | × | × |
| 28 | × | ○ | ○ | ○ | ○ | × | × | × | × |
| 29 | ○ | ○ | ○ | ○ | ○ | × | × | × | × |
| 30 | × | ○ | ○ | ○ | ○ | × | × | × | × |
| 31 | ○ | ○ | ○ | ○ | ○ | × | × | × | × |
| 32 | × | ○ | ○ | ○ | ○ | × | × | × | × |
| 33 | ○ | ○ | ○ | ○ | ○ | × | × | × | × |
| 34 | × | ○ | ○ | ○ | ○ | ○ | × | × | × |
| 35 | ○ | ○ | ○ | ○ | ○ | ○ | × | × | × |
| 36 | × | ○ | ○ | ○ | ○ | ○ | × | × | × |
| 37 | ○ | ○ | ○ | ○ | ○ | ○ | × | × | × |
| 38 | × | ○ | ○ | ○ | ○ | ○ | × | × | × |
| 39 | ○ | ○ | ○ | ○ | ○ | ○ | × | × | × |
| 40 | × | ○ | ○ | ○ | ○ | ○ | × | × | × |
| 41 | ○ | ○ | ○ | ○ | ○ | ○ | × | × | × |
| 42 | × | ○ | ○ | ○ | ○ | ○ | ○ | × | × |
| 43 | ○ | ○ | ○ | ○ | ○ | ○ | ○ | × | × |
| 44 | × | ○ | ○ | ○ | ○ | ○ | ○ | × | × |
| 45 | ○ | ○ | ○ | ○ | ○ | ○ | ○ | × | × |
| 46 | × | ○ | ○ | ○ | ○ | ○ | ○ | × | × |
| 47 | ○ | ○ | ○ | ○ | ○ | ○ | ○ | × | × |
| 48 | × | ○ | ○ | ○ | ○ | ○ | ○ | × | × |
| 49 | ○ | ○ | ○ | ○ | ○ | ○ | ○ | × | × |
| 50 | × | ○ | ○ | ○ | ○ | ○ | ○ | ○ | × |
| 51 | ○ | ○ | ○ | ○ | ○ | ○ | ○ | ○ | × |
| 52 | × | ○ | ○ | ○ | ○ | ○ | ○ | ○ | × |
| 53 | ○ | ○ | ○ | ○ | ○ | ○ | ○ | ○ | × |
| 54 | × | ○ | ○ | ○ | ○ | ○ | ○ | ○ | × |
| 55 | ○ | ○ | ○ | ○ | ○ | ○ | ○ | ○ | × |
| 56 | × | ○ | ○ | ○ | ○ | ○ | ○ | ○ | × |
| 57 | ○ | ○ | ○ | ○ | ○ | ○ | ○ | ○ | × |
| 58 | × | ○ | ○ | ○ | ○ | ○ | ○ | ○ | ○ |
| 59 | ○ | ○ | ○ | ○ | ○ | ○ | ○ | ○ | ○ |
| 60 | × | ○ | ○ | ○ | ○ | ○ | ○ | ○ | ○ |
| 61 | ○ | ○ | ○ | ○ | ○ | ○ | ○ | ○ | ○ |
| 62 | × | ○ | ○ | ○ | ○ | ○ | ○ | ○ | ○ |
| 63 | ○ | ○ | ○ | ○ | ○ | ○ | ○ | ○ | ○ |

○ : Lighting
× : non-Lighting

FIG. 14

Lighting Periods

Gray Scales

| 6bit | 5bit | SF1 | SF2 | SF3 | SF4 | SF7 | SF5 | SF6 |
|---|---|---|---|---|---|---|---|---|
| | | 4 | 4 | 4 | 16 | 32 | 1 | 2 |
| 0 | 0 | × | × | × | × | × | × | × |
| 1 | 1 | × | × | × | × | × | ○ | × |
| 2 | 2 | × | × | × | × | × | × | ○ |
| 3 | 3 | × | × | × | × | × | ○ | ○ |
| 4 | 4 | ○ | × | × | × | × | × | × |
| 5 | 5 | ○ | × | × | × | × | ○ | × |
| 6 | 6 | ○ | × | × | × | × | × | ○ |
| 7 | 7 | ○ | × | × | × | × | ○ | ○ |
| 8 | 8 | ○ | ○ | × | × | × | × | × |
| 9 | 9 | ○ | ○ | × | × | × | ○ | × |
| 10 | 10 | ○ | ○ | × | × | × | × | ○ |
| 11 | 11 | ○ | ○ | × | × | × | ○ | ○ |
| 12 | 12 | ○ | ○ | ○ | × | × | × | × |
| 13 | | ○ | ○ | ○ | × | × | ○ | × |
| 14 | 13 | ○ | ○ | ○ | × | × | × | ○ |
| 15 | | ○ | ○ | ○ | × | × | ○ | ○ |
| 16 | 14 | × | × | × | ○ | × | × | × |
| 17 | | × | × | × | ○ | × | ○ | × |
| 18 | 15 | × | × | × | ○ | × | × | ○ |
| 19 | | × | × | × | ○ | × | ○ | ○ |
| 20 | 16 | ○ | × | × | ○ | × | × | × |
| 21 | | ○ | × | × | ○ | × | ○ | × |
| 22 | 17 | ○ | × | × | ○ | × | × | ○ |
| 23 | | ○ | × | × | ○ | × | ○ | ○ |
| 24 | 18 | ○ | ○ | × | ○ | × | × | × |
| 25 | | ○ | ○ | × | ○ | × | ○ | × |
| 26 | 19 | ○ | ○ | × | ○ | × | × | ○ |
| 27 | | ○ | ○ | × | ○ | × | ○ | ○ |
| 28 | 20 | ○ | ○ | ○ | ○ | × | × | × |
| 29 | | ○ | ○ | ○ | ○ | × | ○ | × |
| 30 | 21 | ○ | ○ | ○ | ○ | × | × | ○ |
| 31 | | ○ | ○ | ○ | ○ | × | ○ | ○ |
| 32 | 22 | × | × | × | × | ○ | × | × |
| 33 | | × | × | × | × | ○ | ○ | × |
| 34 | | × | × | × | × | ○ | × | ○ |
| 35 | 23 | × | × | × | × | ○ | ○ | ○ |
| 36 | | ○ | × | × | × | ○ | × | × |
| 37 | | ○ | × | × | × | ○ | ○ | × |
| 38 | 24 | ○ | × | × | × | ○ | × | ○ |
| 39 | | ○ | × | × | × | ○ | ○ | ○ |
| 40 | | ○ | ○ | × | × | ○ | × | × |
| 41 | 25 | ○ | ○ | × | × | ○ | ○ | × |
| 42 | | ○ | ○ | × | × | ○ | × | ○ |
| 43 | | ○ | ○ | × | × | ○ | ○ | ○ |
| 44 | 26 | ○ | ○ | ○ | × | ○ | × | × |
| 45 | | ○ | ○ | ○ | × | ○ | ○ | × |
| 46 | | ○ | ○ | ○ | × | ○ | × | ○ |
| 47 | 27 | ○ | ○ | ○ | × | ○ | ○ | ○ |
| 48 | | × | × | × | ○ | ○ | × | × |
| 49 | | × | × | × | ○ | ○ | ○ | × |
| 50 | | × | × | × | ○ | ○ | × | ○ |
| 51 | 28 | × | × | × | ○ | ○ | ○ | ○ |
| 52 | | ○ | × | × | ○ | ○ | × | × |
| 53 | | ○ | × | × | ○ | ○ | ○ | × |
| 54 | | ○ | × | × | ○ | ○ | × | ○ |
| 55 | 29 | ○ | × | × | ○ | ○ | ○ | ○ |
| 56 | | ○ | ○ | × | ○ | ○ | × | × |
| 57 | | ○ | ○ | × | ○ | ○ | ○ | × |
| 58 | | ○ | ○ | × | ○ | ○ | × | ○ |
| 59 | 30 | ○ | ○ | × | ○ | ○ | ○ | ○ |
| 60 | | ○ | ○ | ○ | ○ | ○ | × | × |
| 61 | | ○ | ○ | ○ | ○ | ○ | ○ | × |
| 62 | | ○ | ○ | ○ | ○ | ○ | × | ○ |
| 63 | 31 | ○ | ○ | ○ | ○ | ○ | ○ | ○ |

○ : Lighting
× : non-Lighting

FIG. 15

| | | | | | | | | | | |
|---|---|---|---|---|---|---|---|---|---|---|
| 1 | SF1 | SF2 | SF3 | SF4 | SF5 | SF6 | SF7 | SF8 | SF9 | SF10 |
| 2 | SF4 | SF5 | SF6 | SF7 | SF8 | SF9 | SF10 | SF1 | SF2 | SF3 |
| 3 | SF4 | SF5 | SF6 | SF7 | SF1 | SF2 | SF3 | SF9 | SF10 | SF8 |
| 4 | SF4 | SF5 | SF1 | SF6 | SF7 | SF2 | SF8 | SF9 | SF3 | SF10 |
| 5 | SF4 | SF5 | SF2 | SF6 | SF7 | SF1 | SF8 | SF9 | SF3 | SF10 |
| 6 | SF4 | SF8 | SF1 | SF5 | SF10 | SF2 | SF6 | SF9 | SF3 | SF7 |
| 7 | SF4 | SF8 | SF2 | SF5 | SF10 | SF1 | SF6 | SF9 | SF3 | SF7 |
| 8 | SF4 | SF5 | SF1 | SF6 | SF2 | SF7 | SF8 | SF9 | SF3 | SF10 |
| 9 | SF4 | SF5 | SF6 | SF7 | SF1 | SF2 | SF8 | SF9 | SF10 | SF3 |

FIG. 35

| Gray Scales \ Lighting Periods | SF1 | SF2 | SF3 | SF4 | SF5 |
|---|---|---|---|---|---|
| | 1 | 2 | 4 | 8 | 16 |
| 0 | × | × | × | × | × |
| 1 | ○ | × | × | × | × |
| 2 | × | ○ | × | × | × |
| 3 | ○ | ○ | × | × | × |
| 4 | × | × | ○ | × | × |
| 5 | ○ | × | ○ | × | × |
| 6 | × | ○ | ○ | × | × |
| 7 | ○ | ○ | ○ | × | × |
| 8 | × | × | × | ○ | × |
| 9 | ○ | × | × | ○ | × |
| 10 | × | ○ | × | ○ | × |
| 11 | ○ | ○ | × | ○ | × |
| 12 | × | × | ○ | ○ | × |
| 13 | ○ | × | ○ | ○ | × |
| 14 | × | ○ | ○ | ○ | × |
| 15 | ○ | ○ | ○ | ○ | × |
| 16 | × | × | × | × | ○ |
| 17 | ○ | × | × | × | ○ |
| 18 | × | ○ | × | × | ○ |
| 19 | ○ | ○ | × | × | ○ |
| 20 | × | × | ○ | × | ○ |
| 21 | ○ | × | ○ | × | ○ |
| 22 | × | ○ | ○ | × | ○ |
| 23 | ○ | ○ | ○ | × | ○ |
| 24 | × | × | × | ○ | ○ |
| 25 | ○ | × | × | ○ | ○ |
| 26 | × | ○ | × | ○ | ○ |
| 27 | ○ | ○ | × | ○ | ○ |
| 28 | × | × | ○ | ○ | ○ |
| 29 | ○ | × | ○ | ○ | ○ |
| 30 | × | ○ | ○ | ○ | ○ |
| 31 | ○ | ○ | ○ | ○ | ○ |

○ : Lighting
× : non-Lighting

FIG. 36

| Gray Scales \ Lighting Periods | SF1 | SF2 | SF3 | SF4 | SF5 | SF6 | SF7 | SF8 | SF9 |
|---|---|---|---|---|---|---|---|---|---|
| | 1 | 2 | 4 | 4 | 4 | 4 | 4 | 4 | 4 |
| 0 | × | × | × | × | × | × | × | × | × |
| 1 | ○ | × | × | × | × | × | × | × | × |
| 2 | × | ○ | × | × | × | × | × | × | × |
| 3 | ○ | ○ | × | × | × | × | × | × | × |
| 4 | × | × | ○ | × | × | × | × | × | × |
| 5 | ○ | × | ○ | × | × | × | × | × | × |
| 6 | × | ○ | ○ | × | × | × | × | × | × |
| 7 | ○ | ○ | ○ | × | × | × | × | × | × |
| 8 | × | × | ○ | ○ | × | × | × | × | × |
| 9 | ○ | × | ○ | ○ | × | × | × | × | × |
| 10 | × | ○ | ○ | ○ | × | × | × | × | × |
| 11 | ○ | ○ | ○ | ○ | × | × | × | × | × |
| 12 | × | × | ○ | ○ | ○ | × | × | × | × |
| 13 | ○ | × | ○ | ○ | ○ | × | × | × | × |
| 14 | × | ○ | ○ | ○ | ○ | × | × | × | × |
| 15 | ○ | ○ | ○ | ○ | ○ | × | × | × | × |
| 16 | × | × | ○ | ○ | ○ | ○ | × | × | × |
| 17 | ○ | × | ○ | ○ | ○ | ○ | × | × | × |
| 18 | × | ○ | ○ | ○ | ○ | ○ | × | × | × |
| 19 | ○ | ○ | ○ | ○ | ○ | ○ | × | × | × |
| 20 | × | × | ○ | ○ | ○ | ○ | ○ | × | × |
| 21 | ○ | × | ○ | ○ | ○ | ○ | ○ | × | × |
| 22 | × | ○ | ○ | ○ | ○ | ○ | ○ | × | × |
| 23 | ○ | ○ | ○ | ○ | ○ | ○ | ○ | × | × |
| 24 | × | × | ○ | ○ | ○ | ○ | ○ | ○ | × |
| 25 | ○ | × | ○ | ○ | ○ | ○ | ○ | ○ | × |
| 26 | × | ○ | ○ | ○ | ○ | ○ | ○ | ○ | × |
| 27 | ○ | ○ | ○ | ○ | ○ | ○ | ○ | ○ | × |
| 28 | × | × | ○ | ○ | ○ | ○ | ○ | ○ | ○ |
| 29 | ○ | × | ○ | ○ | ○ | ○ | ○ | ○ | ○ |
| 30 | × | ○ | ○ | ○ | ○ | ○ | ○ | ○ | ○ |
| 31 | ○ | ○ | ○ | ○ | ○ | ○ | ○ | ○ | ○ |

○ : Lighting
× : non-Lighting

DRIVING METHOD OF DISPLAY DEVICE

CROSS-REFERENCE TO RELATED APPLICATIONS

This application is a continuation of U.S. application Ser. No. 11/623,388, filed Jan. 16, 2007, now allowed, which claims the benefit of a foreign priority application filed in Japan as Serial No. 2006-012464 on Jan. 20, 2006, both of which are incorporated by reference.

BACKGROUND OF THE INVENTION

1. Field of the Invention

The present invention relates to a driving method of a display device, in particular, a driving method of a display device using a time gray scale method.

2. Description of the Related Art

In recent years, research and development of an active matrix display device using digital video signals have been actively carried out. There are, for example, a light receiving display device like a liquid crystal display (LCD) and a self-light-emitting display device like a plasma display in such an active matrix display device. As a light-emitting element used for the self-light-emitting display device, an organic light-emitting diode (OLED) has been attracting attention. The OLED is also referred to as an organic EL element, an electro luminescence (EL) element, or the like (a display using an EL element is referred to as an EL display). The self-light-emitting display device using the OLED or the like has advantages such as higher visibility of pixels than that of a liquid crystal display, and fast response speed without requiring a back-light. The luminance of the light-emitting element is controlled by the value of a current flowing through the light-emitting element.

It is known that a time gray scale method is used as a method for displaying gray scales with the use of digital video signals in such an active matrix display device.

The time gray scale method is a method for displaying a gray scale by controlling the length of a light-emitting period or the frequency of light emission. In other words, one frame period is divided into a plurality of sub-frame periods, each of which is weighted with respect to the frequency of light emission, a light-emitting time, and the like, and then the total weight (the sum of the frequency of light emission and the sum of the light-emitting time) is differentiated in each gray scale, thereby displaying a gray scale. As an example, FIG. 34 shows a case where one frame is divided into five sub-frames SF1 to SF5 so that the ratio of lighting periods of these sub-frames is weighted to be $2^0:2^1:2^2:2^3:2^4$. FIG. 35 shows a relation between lighting/non-lighting selective patterns of these sub-frames and gray scales. As apparent from FIGS. 34 and 35, by controlling lighting/non-lighting of the sub-frames SF1 to SF5, 32 gray scales of 0 to 31 can be displayed (a gray scale of 1 represents a minimum unit of gray scale change). Since 1 bit is necessary to order lighting/non-lighting of each sub-frame, a 5-bit digital signal is necessary to control the five sub-frames SF1 to SF5. In general, by controlling M sub-frames each having a weighting of power-of-2 with the use of M-bit digital video signals, display of $2^M$ gray scales (that is, a gray scale is 0 to $2^M-1$) can be performed. In this specification, it is to be noted that, in such a manner, a time gray scale method for performing gray scale display by using a plurality of sub-frames which have different weightings is referred to as a binary code time gray scale method. A digital signal bit which controls a sub-frame that is weighted large (for example, SF5) is referred to as a high-order bit, and a digital signal bit which controls a sub-frame that is weighted small (for example, SF1) is referred to as a low-order bit. It is to be noted that the sub-frames may not necessarily be weighted to be power-of-2 and not all sub-frames have to be weighted differently. The weighting (a lighting period or the frequency of flickering) of one sub-frame may be less than or equal to a value of the total weightings of the sub-frames of which weighting is smaller (that is, a lower-order weighting), to which 1 is added. Accordingly, all gray scales can be displayed continuously. For example, when the length ratio of a lighting period of each sub-frame is regarded as 1:1:2:3, all gray scales of from 0 to 7 can be displayed continuously.

In the display device using such a binary code time gray scale method, a false contour (also referred to as a pseudo contour) may be perceived at a portion where the gray scale changes smoothly originally without generating a boundary, when displaying a moving image. It is known that a pseudo contour is likely to be generated when pixels, of which lighting patterns differ largely like a case where one adjacent pixel has a gray scale of 15 and the other has a gray scale of 16, are adjacent to each other. In order to reduce such a pseudo contour, various countermeasures have been proposed (see References 1 to 8: Japanese Patent No. 2903984, Japanese Patent No. 3075335, Japanese Patent No. 2639311, Japanese Patent No. 3322809, Japanese Published Patent Application No. H10-307561, Japanese Patent No. 3585369, Japanese Patent No. 3489884, and Japanese Published Patent Application No. 2001-324958).

For example, Reference 2 discloses that 7 sub-frames having almost the same weighting (high-order sub-frames) are controlled with high-order 7 bits of a 12-bit digital signal that displays gray scales, and a plurality of sub-frames of which weightings are performed in accordance with a binary digit is controlled with the other 5 low-order bits, for example. Here, the seven high-order sub-frames are continuously provided in one frame period, and the high-order sub-frames are sequentially lighted cumulatively as the gray scales increase. In other words, the high-order sub-frames that are lighted at small gray scales are lighted also at large gray scales. Such a gray scale method is referred to as an overlapping time gray scale method.

SUMMARY OF THE INVENTION

As described above, various methods for reducing pseudo contours have been proposed; however, the effect of reducing pseudo contours is not sufficient yet.

For example, FIG. 36 shows a sub-frame lighting pattern with respect to each gray scale in a case where the invention mentioned in Reference 2 is used to display 32 gray scales. In the diagram, two low-order sub-frames SF1 and SF2 each have a weighting of power of 2 (1:2) and are used for a binary code time gray scale method (in this specification, such a sub-frame is referred to as a binary code sub-frame), and sub-frames SF3 to SF9 have the same weighting (4) and are used for an overlapping time gray scale method. When an overlapping time gray scale method and a binary code time gray scale method are combined with each other in such a manner, pseudo contours can be reduced to some degree.

However, in a conventional driving method of a display device mentioned in FIG. 36, nine sub-frames are used in total, in which seven sub-frames are used for an overlapping time gray scale method, and two sub-frames are used for a binary code time gray scale method. Thus, the number of sub-frames is substantially increased compared with a case of a binary code time gray scale method (FIG. 35) in which only five sub-frames are needed to display the same gray scale.

Therefore, the number of bits of a digital signal for controlling the sub-frames is also increased, resulting in a problem that the size of a device gets larger and a high frequency increases the power consumption.

Further, in the conventional driving method of a display device mentioned in FIG. 36, it is assumed that the sub-frames in one frame are lighted in the order of SF1, SF2, . . . , and SF9. In this case, for example, at a gray scale of 11, both of the sub-frames SF1 and SF2 used for a binary code time gray scale method are lighted. On the contrary, at a gray scale of 12, both of the sub-frames SF1 and SF2 are non-lighted, and the sub-frame SF5 used for an overlapping time gray scale method, which is temporally apart from the sub-frames SF1 and SF2 is lighted. Accordingly, lightning patterns between a gray scale of 11 and a gray scale of 12 are largely different, whereby pseudo contours are easily generated.

In view of the foregoing problems, it is a main object of the present invention to provide a driving method of a display device capable of reducing pseudo contours while increase in the number of sub-frames is suppressed as much as possible.

It is another object of the present invention to provide a driving method of a display device having a plurality of sub-frames driven with different gray scale methods, which is capable of reducing generation of pseudo contours.

To solve the above problem, according to one aspect of the present invention, a driving method of a display device is provided, where one frame is divided into a plurality of sub-frames to display a gray scale, where the plurality of sub-frames has a plurality of middle-order sub-frames each of which has a middle-degree weighting and is used for an overlapping time gray scale method, at least one high-order sub-frame which has a larger weighting than that of the middle-order sub-frame and is used for a binary code time gray scale method, and at least one low-order sub-frame which has a smaller weighting than that of the middle-order sub-frame and is used for a binary code time gray scale method; and where lighting or non-lighting of each of the middle-order sub-frame, the high-order sub-frame, and the low-order sub-frame is selected with respect to each pixel of the display device, in each frame. It is to be noted that a sub-frame having "a middle-degree weighting" means that it is neither a sub-frame having the smallest weighting nor a sub-frame having the largest weighting. Further, a plurality of middle-order sub-frames is not necessary to have the same weighting.

Preferably, the low-order sub-frame includes a sub-frame having a weighting of 1 and a sub-frame having a weighting of 2. Alternatively, the low-order sub-frame may be formed using a sub-frame having a weighting of 1.

Preferably, the plurality of middle-order sub-frames has the same weighting, at least one of the high-order sub-frames is divided into a plurality of divided sub-frames, at least one of the plurality of divided sub-frames has a weighting Q times (Q is an integer greater than or equal to 1 and less than or equal to the total number of the middle-order sub-frames) as large as that of the middle-order sub-frame, and Q middle-order sub-frames and at least one of the divided sub-frames are interchangeable with each other. In a case where Q is 1, an arbitrary middle-order sub-frame and at least one of the divided sub-frames are interchangeable with each other. It is to be noted that, in this application, "the same weighting" includes a case where weightings have some difference due to an error or the like.

Preferably, in a case where the high-order sub-frame has at least two sub-frames, at least one of the at least two high-order sub-frames is divided into a plurality of divided sub-frames, at least one of the plurality of divided sub-frames has the same weighting as that of at least one of other high-order sub-frames, whereby at least one of the divided sub-frames and at least one of the other high-order sub-frames are interchangeable with each other.

According to another aspect of the present invention, a driving method of a display device is provided, where one frame is divided into a plurality of sub-frames to display a gray scale, where the plurality of sub-frames has a first sub-frame group including a plurality of sub-frames which has the same weighting and is driven with an overlapping time gray scale method, and a second sub-frame group including a plurality of sub-frames having a smaller weighting than that of the sub-frame in the first sub-frame group; where the second sub-frame group is arranged so that the sub-frames therein are adjacently arranged in one frame to form a sub-frame region, and every time the sub-frames in the second sub-frame group are turned from an all-lighting state to an all-non-lighting state in accordance with increase in gray scale, the sub-frame, which is temporally adjacent to the sub-frame region among the sub-frames belonging to the first sub-frame group, is turned from a non-lighting state to a lighting state.

Alternatively, a driving method of a display device is provided, where one frame is divided into a plurality of sub-frames to display a gray scale, where the plurality of sub-frames has a first sub-frame group including a plurality of sub-frames which has the same weighting and is driven with an overlapping time gray scale method, and a second sub-frame group including a plurality of sub-frames having a smaller weighting than that of the sub-frame in the first sub-frame group; where, every time the sub-frames in the second sub-frame group are turned from an all-lighting state to an all-non-lighting state in accordance with increase in gray scale, the sub-frame, which is temporally adjacent to the sub-frame having the largest weighting among the sub-frames belonging to the second sub-frame group, among the sub-frames belonging to the first sub-frame group, is turned from a non-lighting state to a lighting state.

According to still another aspect of the present invention, a driving method of a display device where one frame is divided into a plurality of sub-frames to display a gray scale, having one low-order sub-frame or a plurality of low-order sub-frames, including a sub-frame having a weighting of 1; and one high-order sub-frame or a plurality of high-order sub-frames, having a larger weighting than that of the low-order sub-frame, where a gray scale is displayed using a selective lighting of the low-order sub-frame and the high-order sub-frame, and an image processing.

Preferably, the image processing can be a dither diffusion method or an error diffusion method (which is also called random dither method).

Preferably, the low-order sub-frame has a sub-frame having a weighting of 1 and a sub-frame having a weighting of 2.

Preferably, the display device having a driving method of the present invention may be a light emitting device such as an organic EL display, an inorganic EL display, a plasma display, a field emission display (FED), or a surface-conduction electron-emitter display (SED); a reflection type display device such as a digital micromirror device (DMD), a grating light valve (GLV), or a reflection type liquid crystal display; or a liquid crystal display device such as a ferroelectric liquid crystal display or an anti-ferroelectric liquid crystal display.

According to one aspect of the present invention, pseudo contours can be reduced by a plurality of middle-order sub-frames which has a middle-degree weighting and is used for an overlapping time gray scale method. Further, increase in the total number of sub-frames can be suppressed by at least one high-order sub-frame which has a larger weighting than that of the middle-order sub-frame and is used for a binary code time gray scale method. In addition, fine gray scales (that is, there is only a small difference between adjacent gray scales) can be efficiently displayed by at least one low-order sub-frame which has a smaller weighting than that of the middle-order sub-frame and is used for a binary code time gray scale method.

According to another aspect of the present invention, a first sub-frame group including a plurality of sub-frames which has the same weighting and is driven with an overlapping time gray scale method, and a second sub-frame group including a plurality of sub-frames which has a smaller weighting than that of the sub-frame in the first sub-frame group are included. In a case where a second sub-frame group is arranged so that the sub-frames therein are adjacently arranged in one frame to form a sub-frame region, every time the sub-frames in the second sub-frame group are turned from an all-lighting state to an all-non-lighting state in accordance with increase in gray scale, the sub-frame, which is temporally adjacent to the sub-frame region among sub-frames belonging to the first sub-frame group, is turned from a non-lighting state to a lighting state, whereby change in sub-frame lighting pattern can be as small as possible; therefore, pseudo contours can be reduced.

According to another aspect of the present invention, in a display device having a low-order sub-frame including a sub-frame having a weighting of 1, and one high-order sub-frame or a plurality of high-order sub-frames having a larger weighting than that of the low-order sub-frame, a gray scale, which cannot be displayed by the combination of lighting/non-lighting of the sub-frames because a sub-frame (a middle-order sub-frame) having a weighting between the low-order sub-frame and the high-order sub-frame, is displayed using a selective lighting of the low-order sub-frame and the high-order sub-frame, and an image processing, whereby pseudo contours which can be generated in using the middle-order sub-frame can be avoided. Further, by selectively lighting the low-order sub-frame in displaying a gray scale using an image processing, a minute difference between gray scales can be displayed without using a complicated image processing, whereby an expensive IC or the like for performing a complicated image processing can be eliminated.

BRIEF DESCRIPTION OF THE DRAWINGS

In the accompanying drawings:

FIG. 1 is a diagram explaining a driving method of a display device based on an embodiment mode of the present invention;

FIG. 2 is a diagram explaining a driving method of a display device based on an embodiment mode of the present invention;

FIG. 3 is a diagram explaining a driving method of a display device based on an embodiment mode of the present invention;

FIG. 4 is a diagram explaining a driving method of a display device based on an embodiment mode of the present invention;

FIG. 5 is a diagram explaining a driving method of a display device based on an embodiment mode of the present invention;

FIG. 6 is a diagram explaining a driving method of a display device based on an embodiment mode of the present invention;

FIG. 7 is a diagram explaining a driving method of a display device based on an embodiment mode of the present invention;

FIG. 8 is a diagram explaining a driving method of a display device based on an embodiment mode of the present invention;

FIG. 9 is a diagram explaining a driving method of a display device based on an embodiment mode of the present invention;

FIG. 10 is a diagram explaining a driving method of a display device based on an embodiment mode of the present invention;

FIG. 11 is a diagram explaining a driving method of a display device based on an embodiment mode of the present invention;

FIG. 12 is a diagram explaining a driving method of a display device based on an embodiment mode of the present invention;

FIG. 13 is a diagram explaining a driving method of a display device based on an embodiment mode of the present invention;

FIG. 14 is a diagram explaining a driving method of a display device based on an embodiment mode of the present invention;

FIG. 15 is a diagram explaining a structure of a driving method of a display device of the present invention;

FIG. 35 is a diagram explaining a driving method of a conventional display device; and FIG. 36 is a diagram explaining another example of a driving method of a conventional display device.

DETAILED DESCRIPTION OF THE INVENTION

Figure 16:
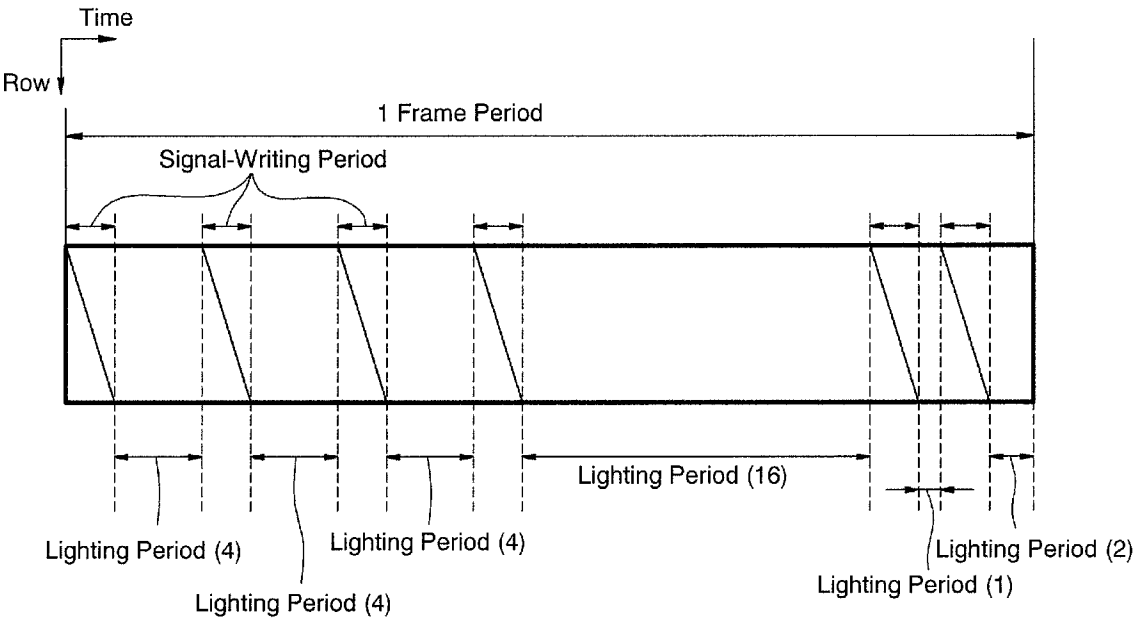
FIG. 16 is a diagram explaining a structure of a driving method of a display device of the present invention.

Embodiment modes of the present invention will be explained below with reference to the accompanying drawings. However, it is to be easily understood that various changes and modifications will be apparent to those skilled in the art without departing from the purpose and the scope of the present invention. Therefore, the present invention should not be interpreted as being limited to the description of the embodiment modes.

Embodiment Mode 1

FIG. 1 is a diagram showing a lighting pattern of a sub-frame based on a preferred embodiment mode of the present invention. This embodiment mode has, in order that 32 ($2^5$) gray scales of gray scales of 0 to 31 are displayed, three middle-order sub-frames SF1 to SF3 each of which has the same middle-degree weighting (4) and is driven with an overlapping time gray scale method; a highest-order sub-frame SF4 which has a large weighting (16); and two low-order sub-frames SF5 and SF6 each of which has a small weighting (1, 2) and is driven with a binary code time gray scale method. As with a conventional example, also in this embodiment mode, various gray scales can be displayed by selectively lighting the sub-frames SF1 to SF6. It is to be noted that the lighting order of the sub-frames in one frame can take various modes, that is, the order may be the order from SF1 to SF6; from a sub-frame having a small weighting to a sub-frame having a large weighting, or the reverse; random; or may be changed per one frame.

With such a structure, pseudo contours can be reduced by driving the middle-order sub-frames SF1 to SF3 each having a middle-degree weighting, with an overlapping time gray scale method. Since there is the sub-frame SF4, which has a larger weighting than that of the sub-frames SF1 to SF3 driven with an overlapping time gray scale method, the total number of sub-frames can be 6. Thus, the number of sub-frames is substantially reduced compared with 9, which is the number of sub-frames of related art shown in FIG. 36. Further, fine gray scales can be efficiently displayed by the low-order sub-frames SF5 and SF6 driven with a binary code time gray scale method. In such a manner, according to the present invention, by introducing a sub-frame driven with an overlapping time gray scale method, production of pseudo contours can be efficiently reduced while increase in the total number of sub-frames is suppressed.

FIG. 2 shows a deformation example of the embodiment mode of FIG. 1. The embodiment mode of FIG. 2 is different from FIG. 1 in that a sub-frame SF7 having a weighting of 32 is added, and there are 7 sub-frames in total, whereby 64 gray scales of gray scales of 0 to 63 can be displayed. That is, in the embodiment mode of FIG. 2, high-order sub-frames SF4 and SF7 are driven with a binary code time gray scale method. In the embodiment mode of FIG. 1, a high-order sub-frame having a larger weighting than that of the sub-frames SF1 to SF3 driven with an overlapping time gray scale method is only the highest-order sub-frame SF4; however, in this specification, such driving of only one sub-frame is also included in a binary code time gray scale method.

The embodiment mode of FIG. 2 also has the sub-frames SF1 to SF3 each having a middle-degree weighting (4); therefore, pseudo contours are reduced. Further, since there are the high-order sub-frames SF4 and SF7 driven with a binary code time gray scale method, the total number of sub-frames is 7, that is, increase in the number of sub-frames is suppressed. Furthermore, fine gray scales can also be efficiently displayed by the low-order sub-frames SF5 and SF6 driven with a binary code time gray scale method. As described above, the present invention is applicable to a display device of various gray scales (or the number of bits), and generation of pseudo contours can be reduced while the number of sub-frames is suppressed.

FIG. 3 is a diagram showing a sub-frame lighting pattern based on another deformation example of the embodiment mode of FIG. 1. The embodiment mode of FIG. 3 is different from FIG. 1 in that the highest-order sub-frame SF4 in FIG. 1 is divided into two sub-frames (referred to as divided sub-frames) SF4*a* and SF4*b* each having a weighting of 8. The weighting (8) of each of the sub-frames SF4*a* and SF4*b* is equal to twice as large as a weighting (4) of each middle-order sub-frames SF1 to SF3 used for an overlapping time gray scale method. Accordingly, among the sub-frames SF1 to SF3 and a sub-frame SF6 which light at a gray scale of 14, the sub-frames SF1 and SF2 are replaced with the sub-frame SF4*a*, whereby a different sub-frame lighting pattern (14') is additionally set. In the same manner, with respect to a gray scale of 15, any two of the three middle-order sub-frames SF1 to SF3 are replaced with the sub-frame SF4*a* or SF4*b*, whereby three different sub-frame lighting patterns (15', 15", and 15*a*) are added. Sub-frames to be lighted, of a lighting pattern at a gray scale of 15, do not overlap with that of a lighting pattern at a gray scale of 16. On the contrary, the sub-frame SF4*a* or SF4*b* of the three sub-frame lighting patterns overlap with that of the lighting pattern at a gray scale of 16. Accordingly, the three sub-frame lighting patterns are more similar to the lighting pattern at a gray scale of 16. Further, in the embodiment mode of FIG. 3, with respect to a gray scale of 16, one of the sub-frames SF4*a* and SF4*b* to be lighted (in an example of FIG. 3, the sub-frame SF4*b*) is replaced with any two of the three middle-order sub-frames SF1 to SF3 (in the example of FIG. 3, the sub-frames SF2 and SF3), whereby one different sub-frame lighting pattern (16') is added with respect to a gray scale of 16. When the sub-frame lighting pattern (16') and the sub-frame lighting pattern at a gray scale of 15 are compared with each other, the sub-frames SF2 and SF3 are lighted in common. Therefore, the lighting pattern of 16' is more similar to the lighting pattern of 15 than the lighting pattern of 16. In such a manner, with respect to a desired gray scale, a plurality of sub-frame lighting patterns can be prepared, and a sub-frame lighting pattern to be used among the plurality of sub-frame lighting patterns can be changed in accordance with each row, column, pixel, frame, or the like. Accordingly, for example, in a case where a gray scale of 16 is displayed in a pixel B adjacent to a pixel A when the pixel A is at a gray scale of 15 (SF1 to SF3, SF5, and SF6 are lighted), any of the lighting patterns 15', 15", and 15*a* is used, whereby pseudo contours can be reduced.

Patterns other than that shown in the diagram can be employed for the sub-frame lighting patterns of gray scales of 14, 15, and 16, and a plurality of sub-frame lighting patterns can be set also at gray scales other than 14, 15, and 16. In the embodiment mode of FIG. 3, the sub-frame SF4 having a weighting of 16 is divided into the two sub-frames SF4*a* and SF4*b* each having a weighting of 8; however, the present invention is not necessarily limited thereto. For example, the sub-frame SF4 having a weighting of 16 can be divided into a sub-frame having a weighting of 12 and a sub-frame having a weighting of 4. In that case, the sub-frame having a weighting of 12 is interchangeable with three sub-frames SF1 to SF3, and the sub-frame having a weighting of 4 is interchangeable with any one of the sub-frames SF1 to SF3. In general, in a case of having a plurality of middle-order sub-frames each of which is used for an overlapping time gray scale method and has the same weighting; and at least one high-order sub-frame which has a larger weighting than that of the middle-order sub-frame and is used for a binary code time gray scale method, at least one high-order sub-frame is divided into a plurality of divided sub-frames, and at least one of the plurality of divided sub-frames is weighted Q times (Q is an integer greater than or equal to 1 and less than or equal to the total number of the middle-order sub-frames) as large as the middle-order sub-frame, whereby Q middle-order sub-frames and at least one of the divided sub-frames are interchangeable with each other. By utilizing that, a plurality of sub-frame lighting patterns can be set with respect to a predetermined gray scale.

FIG. 4 is a diagram showing a sub-frame lighting pattern based on still another deformation example of the embodiment mode of FIG. 1. The embodiment mode of FIG. 4 is different from FIG. 1 in that the highest-order sub-frame SF4 in FIG. 1 is divided into three sub-frames of two sub-frames SF4*a* and SF4*b* each having a weighting of 4 and one sub-frame 4*c* having a weighting of 8. Thus, the division number of the high-order sub-frame is arbitrary, without being limited to 2. Each of the sub-frames SF4*a* and SF4*b* having a weighting of 4 is interchangeable with one of sub-frames SF1 to SF3 each having a weighting of 4 used for an overlapping time gray scale method. The sub-frame 4*c* having a weighting of 8 is interchangeable with two of the sub-frames SF1 to SF3 each having a weighting of 4. Accordingly, in the embodiment mode of FIG. 4, among the sub-frames SF1 to SF3 and a sub-frame SF6 which light at a gray scale of 14, the sub-frame SF1 is replaced with the sub-frame SF4*a*, whereby a different sub-frame lighting pattern (14') is additionally set. In the same manner, with respect to a gray scale of 15, five different sub-frame lighting patterns (15', 15", 15*a*, 15*b*, and 15*c*) are added, and with respect to a gray scale of 16, one different sub-frame lighting pattern (16') is added. It may be easily understood that, also in this case, a different sub-frame lighting pattern which can be added is not limited to that shown in the diagram, and that another sub-frame lighting pattern can be set. Also in the embodiment mode of FIG. 4, in the same manner as the embodiment mode of FIG. 3, in a case where a gray scale in which a plurality of sub-frame lighting patterns is set is displayed in a pixel, one of the plurality of sub-frame lighting patterns is selectively used in accordance with a gray scale or the like of an adjacent pixel, whereby pseudo contours can be reduced.

FIG. 5 is a diagram showing still another embodiment mode of a sub-frame lighting pattern based on the present invention. This embodiment mode has, in order that 32 ($2^5$) gray scales of gray scales of 0 to 31 are displayed, three middle-order sub-frames SF1 to SF3 each of which has the same middle-degree weighting (2) and is driven with an overlapping time gray scale method, high-order sub-frames SF4 and SF5 each of which has a different weighting (16, 32) and is driven with a binary code time gray scale method, and one low-order sub-frame SF6 which has a small weighting (1) and is driven with a binary code time gray scale method. The embodiment mode of FIG. 5 also has the three sub-frames SF1 to SF3 each having a middle-degree weighting (2), whereby pseudo contours are reduced. Further, since there are the high-order sub-frames SF4 and SF5 driven with a binary code time gray scale method, the total number of sub-frames is 6, that is, increase in the number of sub-frames is suppressed. In such a manner, the present invention is applicable to a case where only one lowest-order sub-frame (SF6) is included in a low-order sub-frame driven with a binary code time gray scale method, whereby pseudo contours can be reduced.

FIG. 6 is a diagram showing a deformation example of the embodiment mode of FIG. 5. The embodiment mode of FIG. 6 is different from that of FIG. 5 in that the highest-order sub-frame SF5 in FIG. 5 is divided into two sub-frames of SF5*a* and SF5*b* each having a weighting of 8. Each of the sub-frames SF5*a* and SF5*b* which has a weighting of 8 is interchangeable with a high-order sub-frame SF4 which also has a weighting of 8. Accordingly, in the embodiment mode of FIG. 6, among sub-frames SF1 to SF4 and a sub-frame SF6 which light at a gray scale of 15, the sub-frame SF4 is replaced with the sub-frame SF5*a*, whereby a different sub-frame lighting pattern (15') is additionally set. Accordingly, in a case where a gray scale of 15 is displayed in a pixel, a lighting pattern (15) by which the sub-frames SF1 to SF4 are lighted or a lighting pattern (15') by which the sub-frames SF1 to SF3 and SF5*a* are lighted is selectively used in accordance with a gray scale or the like of an adjacent pixel, whereby pseudo contours can be reduced. Also in this case, a gray scale which can set a plurality of sub-frame lighting patterns is not limited to 15. For example, the sub-frame SF5*a* or SF5*b* is lighted instead of the sub-frame SF4 at any of gray scales 8 to 14, whereby another sub-frame lighting pattern can be added.

FIG. 7 is a diagram showing a sub-frame lighting pattern based on another embodiment mode of the present invention. The embodiment mode has nine sub-frames SF1 to SF9, and the nine sub-frames are classified into two groups. That is, the sub-frames SF3 to SF9 form a first sub-frame group which has the same weighting (4) and is used for an overlapping time gray scale method, and the sub-frames 1 and 2 form a second sub-frame group which has a smaller weighting of power of 2 (1:2) than that of the overlapping sub-frames SF3 to SF9 and is used for a binary code time gray scale method. As shown in the diagram, 32 gray scales (0 to 31) can be displayed by selecting lighting/non-lighting of these sub-frames SF1 to SF9. In the embodiment mode of FIG. 7, the lighting order of the sub-frames SF1 to SF9 in one frame is in numeric order (namely, SF1, SF2, . . . , SF9). That is, a binary code sub-frame region and an overlapping sub-frame region which uses different driving methods are adjacent to each other such that, in one frame, the binary code sub-frame region is on the left side (temporally former side) of the boundary which exists between sub-frames SF2 and SF3, and the overlapping sub-frame region is on the right side (temporally latter side) of the boundary. In the embodiment mode of FIG. 7, when the sub-frames SF1 and SF2 used for a binary code time gray scale method are turned from an all-lighting state to an all-non-lighting state (that is, a gray scale of from 3 to 4, from 7 to 8, and the like) in accordance with increase in gray scale, among sub-frames used for an overlapping time gray scale method, the sub-frame SF3 temporally adjacent to the binary code sub-frame region is turned from a non-lighting state to a lighting state. Accordingly, at a gray scale in which one or both of the sub-frames SF1 and SF2 used for a binary code time gray scale method is/are lighted, such as gray scales 5 to 7, 9 to 11, and 13 to 15, another overlapping sub-frame is lighted instead of the sub-frame SF3.

In such a manner, every time the low-order sub-frames SF1 and SF2 driven with a binary code time gray scale method are turned from an all-lighting state to an all-non-lighting state in accordance with increase in gray scale, among high-order overlapping sub-frames (or sub-frames belonging to the first sub-frame group), the sub-frame SF3 temporally adjacent to the binary code sub-frame region is lighted, whereby change in sub-frame lighting pattern can be as small as possible, and pseudo contours can be reduced.

In the embodiment mode of FIG. 7, the sub-frames SF1 and SF2 driven with a binary code time gray scale method and the sub-frames SF3 to SF9 driven with an overlapping time gray scale method are adjacent; however, the present invention is not limited thereto. For example, as shown in FIG. 8, three sub-frames SF1, SF2*a*, and SF2*b* each of which has a weighting of 1 and is driven with an overlapping time gray scale method can be employed instead of the low-order sub-frames SF1 and SF2 driven with a binary code time gray scale method. That is, in the embodiment mode of FIG. 8, two overlapping sub-frame regions (or sub-frame groups) having sub-frames having different weightings are adjacent to each other. Also in this case, when three overlapping sub-frames SF1 to SF3 each having a weighting of 1, included in a low-order overlapping sub-frame region, are turned from an all-lighting state to an all-non-lighting state in accordance with increase in gray scale, among seven overlapping sub-frames SF3 to SF9 each having a weighting of 4, included in a high-order overlapping sub-frame region, the sub-frame SF3 adjacent to the low-order overlapping sub-frame region is turned from a non-lighting state to a lighting state, whereby the same effect as that described in the embodiment mode of FIG. 7 can be obtained. Thus, a low-order sub-frame region of different sub-frame regions adjacent to each other may be driven with a binary code time gray scale method or an overlapping time gray scale method.

FIG. 9 is a diagram showing a sub-frame lighting pattern based on another embodiment mode of FIG. 7. The embodiment mode has ten sub-frames SF1 to SF10, in which three low-order sub-frames SF1 to SF3 each have a weighting of power of 2 (1:2:4) and are used for a binary code time gray scale method, and sub-frames SF4 to SF10 have the same weighting (8) larger than that of the sub-frames SF1 to SF3 and are used for an overlapping time gray scale method. By selecting lighting/non-lighting of these sub-frames, 64 gray scales (0 to 63) can be displayed. Also in this embodiment mode, the lighting order of the sub-frames SF1 to SF10 in one frame is in numeric order (namely, SF1, SF2, . . . , SF10). The low-order sub-frames SF1 to SF3 form a binary code sub-frame region, and the high-order sub-frames SF4 to SF10 form an overlapping sub-frame region. These sub-frame regions are adjacent to each other so as to interpose the boundary which exists between the sub-frames SF3 and SF4. In the embodiment mode of FIG. 9, every time the sub-frames SF1 to SF3 used for a binary code time gray scale method are turned from an all-lighting state to an all-non-lighting state (that is, a gray scale of from 7 to 8, from 15 to 16, and the like) in accordance with increase in gray scale, among sub-frames used for an overlapping time gray scale method, the sub-frame SF4 temporally adjacent to the binary code sub-frame region is turned from a non-lighting state to a lighting state. Therefore, at a gray scale at which any or all of the sub-frames SF1 to SF3 used for a binary code time gray scale method is/are lighted, such as gray scales 9 to 15 and 17 to 23, another overlapping sub-frame is lighted instead of the sub-frame SF4. When the sub-frames SF1 to SF3 are turned from an all-lighting state to an all-non-lighting state in accordance with increase in gray scale, among overlapping sub-frames, the sub-frame SF4 adjacent to the low-order binary code sub-frame region is lighted, whereby change in sub-frame lighting pattern can be as small as possible, and pseudo contours can be reduced. As described above, the present invention is applicable to an arbitrary gray scale.

FIG. 10 is a diagram showing a sub-frame lighting pattern based on a deformation example of the embodiment mode of FIG. 9. The embodiment mode of FIG. 10 is different from the embodiment mode of FIG. 9 in that the overlapping sub-frame SF4 adjacent to the binary code sub-frame region is lighted at 2 gray scales in succession (for example, gray scales of 8 and 9 or gray scales of 16 and 17). In such a manner, in order that, when the sub-frames SF1 to SF3 included in a low-order sub-frame region are turned from an all-lighting state to an all-non-lighting state in accordance with increase in gray scale, among high-order overlapping sub-frames, the sub-frame SF4 adjacent to the sub-frames SF1 to SF3 (binary code sub-frame region) can be turned from a blinking state to a lighting state, the sub-frame SF4 may be non-lighted at a gray scale at which the sub-frames SF1 to SF3 are all-lighted, and the sub-frame SF4 is not necessary to be non-lighted at all gray scales other than the gray scale.

FIG. 11 is a diagram showing a sub-frame lighting pattern based on still another aspect of the present invention. The embodiment mode of FIG. 11 has six sub-frames SF1 to SF6, in which two low-order sub-frames SF1 and SF2 each have a weighting of power of 2 (1:2) and are used for a binary code time gray scale method, and sub-frames SF3 to SF6 each have the same weighting (16) larger than that of the two low-order sub-frames SF1 and SF2 and are used for an overlapping time gray scale method. The embodiment mode of FIG. 11 has no sub-frame having a middle weighting (4 and 8). Therefore, although gray scales of 0 to 3, 16 to 19, 32 to 35, and 38 to 51 can be displayed by the combination of lighting/non-lighting of the sub-frames SF1 to SF6, other gray scales, namely gray scales of 4 to 15, 20 to 31, 36 to 37, and 52 to 63 cannot be displayed by the combination of lighting/non-lighting of the sub-frames SF1 to SF6. In this embodiment mode, these gray scales, which cannot be displayed by the combination of lighting/non-lighting of the sub-frames SF1 to SF6, are displayed using an image processing such as a dither diffusion method or an error diffusion method. That is, gray scales of 4 to 15 are displayed by lighting SF3 (weighting of 16) and using an image processing, gray scales of 20 to 31 are displayed by lighting SF3 and SF4 (weighting of 32 in total) and using an image processing, gray scales of 36 to 37 are displayed by lighting SF3 to SF5 (weighting of 48 in total) and using an image processing, and gray scales of 52 to 63 are displayed by lighting SF3 to SF6 (weighting of 64 in total) and using an image processing. Here, according to the present invention, the embodiment mode of FIG. 11 has the low-order sub-frames SF1 and SF2 each having a small weighting (1, 2); therefore, these low-order sub-frames SF1 and SF2 are selectively lighted in displaying a gray scale using an image processing. Accordingly, a minute difference between gray scales can be displayed without using a complicated image processing, whereby an expensive IC or the like for performing a complicated image processing can be eliminated. Further, pseudo contours can be avoided, which can be generated in a case of performing a binary code time gray scale method by additionally using a sub-frame having a middle-degree weighting such as a weighting of 4 or 8.

FIG. 12 is a diagram showing a sub-frame lighting pattern based on a deformation example of the embodiment mode of FIG. 11. The embodiment mode of FIG. 12 is the same as the embodiment mode of FIG. 11 in that the embodiment mode of FIG. 12 has two low-order sub-frames SF1 and SF2 each of which has a weighting of power of 2 (1:2) and is used for a binary code time gray scale method. However, the embodiment mode of FIG. 12 is different from the embodiment mode of FIG. 11 in that, the embodiment mode of FIG. 12 has eight sub-frames SF3 to SF10 each having a weighting of 8 as high-order sub-frames used for an overlapping time gray scale method, instead of the four sub-frames each having a weighting of 16. Since this embodiment mode also has no sub-frame having a middle weighting (4), gray scales of 4 to 7, 12 to 15, 20 to 23, 28 to 31, 36 to 39, 44 to 47, 52 to 55, and 60 to 63 cannot be displayed by the combination of lighting/non-lighting of the sub-frames SF1 to SF10. Therefore, these gray scales are displayed using an image processing such as a dither diffusion method or an error diffusion method. Since the embodiment mode of FIG. 12 also has the low-order sub-frames SF1 and SF2 each having a small weighting (1, 2), not only the high-order sub-frames but also these low-order sub-frames SF1 and SF2 are selectively lighted in displaying a gray scale using an image processing. Accordingly, a minute difference between gray scales can be displayed without using a complicated image processing, whereby an expensive IC or the like for performing a complicated image processing can be eliminated. Further, pseudo contours can be avoided, which can be generated in a case of performing a binary code time gray scale method by additionally using a sub-frame having a middle-degree weighting such as a weighting of 4.

FIG. 13 is a diagram showing a sub-frame lighting pattern based on a deformation example of the embodiment mode of FIG. 12. The embodiment mode of FIG. 13 is the same as the embodiment mode of FIG. 12 in that eight sub-frames SF2 to SF9 each of which is driven with an overlapping time gray scale method and has a weighting of 8. However, the embodiment mode of FIG. 13 is different from the embodiment mode of FIG. 12 in that the embodiment mode of FIG. 13 has only a sub-frame SF1 having a weighting of 1 as a low-order sub-frame having a small weighting. Since, in this embodiment mode of FIG. 13, gray scales of 2 to 7, 10 to 15, 18 to 23, 26 to 31, 34 to 39, 42 to 47, 50 to 55, and 58 to 63 cannot be displayed by the combination of lighting/non-lighting of the sub-frames SF1 to SF9. Therefore, these gray scales are displayed using an image processing such as a dither diffusion method or an error diffusion method. The embodiment mode of FIG. 13 also has a low-order sub-frames SF1 having a small weighting (1); therefore, not only the high-order sub-frames but also the low-order sub-frame SF1 are selectively lighted in displaying a gray scale displayed using an image processing. Accordingly, a minute difference between gray scales can be displayed without using a complicated image processing. Further, pseudo contours can be avoided, which can be generated in a case of performing a binary code time gray scale method by additionally using a sub-frame having a middle-degree weighting such as a weighting of 4. Thus, the number of low-order sub-frames each having a small weighting for displaying a minute difference between gray scales is arbitrary; however, it is preferable to have a sub-frame having a weighting of 1 (that is, a minimum weighting).

The above description is made on the case where a lighting period increases in linear proportion to a gray scale. Thus, next, description will be made on an embodiment mode applying the present invention to a case where a gamma correction is performed. The gamma correction is performed so that a lighting period increases nonlinearly as a gray scale increases. Even when a luminance increases in linear proportion, human eyes cannot sense that luminance increases in proportion. As a luminance increases, the difference of brightness is less visible to human eyes. Therefore, in order that the difference of brightness is visible to human eyes, it is preferable that a lighting period increase as a gray scale increases, that is, a gamma correction be performed.

As a gamma correction method, a larger number of bits (gray scales) than the number of bits (gray scales) to be actually displayed are prepared. For example, when 6 bits (64 gray scales) are displayed, 8 bits (256 gray scales) are actually prepared to be displayed. When actually performing the display, 6 bits (64 gray scales) are displayed so that the luminance of a gray scale has a non-linear shape. Accordingly, a gamma correction can be achieved.

As an example, FIG. 14 shows a selecting method of sub-frames in the case where 5 bits (32 gray scales) are displayed by performing a gamma correction, while 6 bits (64 gray scales) are prepared to be displayed. In the same manner as the embodiment mode of FIG. 2, an embodiment mode of FIG. 14 has three middle-order sub-frames SF1 to SF3 each of which has the same middle-degree weighting (4) and is driven with an overlapping time gray scale method, two high-order sub-frames SF4 and SF7 each of which has a larger weighting (16, 32) than that of the middle-order sub-frames SF1 to SF3 and is driven with a binary code time gray scale method, and two low-order sub-frames SF5 and SF6 each of which has a smaller weighting (1, 2) than that of the middle-order sub-frames SF1 to SF3 and is driven with a binary code time gray scale method, which are capable of displaying 64 ($2^6$) gray scales of gray scales of 0 to 63 in 6-bit display by selectively lighting these sub-frames SF1 to SF7. By allocating these gray scales of 0 to 63 of 6-bit display for gray scales of 0 to 31 of 5-bit display, a gamma correction can be achieved in the 5-bit display. In other words, in FIG. 14, gray scales of 0 to 12 in 5 bits are the same as those in 6 bits. However, as for a gray scale of 13 in 5 bits, to which a gamma correction has been performed, lighting is actually performed using a selecting method of sub-frames in a case of a gray scale of 14 in 6 bits. In the same manner, as for a gray scale of 14 in 5 bits, to which a gamma correction has been performed, a gray scale of 16 in 6 bits is actually displayed. As for a gray scale of 15 in 5 bits, to which a gamma correction has been performed, a gray scale of 18 in 6 bits is actually displayed. Thus, display may be performed depending on a table in which gray scales in 5 bits, to which a gamma correction has been performed, are related to gray scales in 6 bits. Accordingly, a gamma correction can be achieved.

It is to be noted that the table in which gray scales in 5 bits, to which a gamma correction is performed, are related to gray scales in 6 bits can be changed appropriately. Accordingly, by changing the table, the level of a gamma correction can be easily changed.

The number of bits p (p is a natural number) to be displayed and the number of bits q (q is a natural number) to which a gamma correction is performed, are arbitrary values. In the case where display is performed after a gamma correction, the number of bits p is desirably set as large as possible to display gray scales smoothly. It is to be noted that, when the number of bits p is too large, the number of p bits may adversely affect such that the number of sub-frames is too large. Therefore, a relation between the number of bits q and the number of bits p is desirably set to $q+2 \leq p \leq q+5$. Consequently, gray scales can be displayed smoothly without increasing the number of sub-frames too much.

As described above, the present invention is applicable to a case where a gamma correction is performed, by which a lighting period (luminance) is increased nonlinearly with respect to a gray scale.

The above description is made on the displaying method of gray scales, that is, the selecting method of sub-frames. Next, description will be made on the order that a sub-frame appears.

As an example, as for the case of FIG. 9, FIG. 15 shows pattern examples of the order of appearance of sub-frames. It is to be noted that, in FIG. 15, sub-frames SF4 to SF10 (a first sub-frame group) driven with an overlapping time gray scale method are shown in non-shaded regions, and sub-frames SF1 to SF3 (a second sub-frame group) driven with a binary code time gray scale method are shown in shaded regions.

As a first pattern, sub-frames appear in the order of SF1, SF2, SF3, SF4, SF5, SF6, SF7, SF8, SF9, and SF10. The sub-frames SF1 to SF3 using a binary code time gray scale method are arranged together (that is, adjacently) at the top of one frame to form a binary code sub-frame region. In this case, as shown in FIG. 2, every time the binary code sub-frames SF1 to SF3 are turned from an all-lighting state to an all-non-lighting state, the sub-frame SF4 adjacent to the binary code sub-frame region is turned from a non-lighting state to a lighting state.

As a second pattern, sub-frames appear in the order of SF4, SF5, SF6, SF7, SF8, SF9, SF10, SF1, SF2, and SF3. The sub-frames SF1 to SF3 using a binary code time gray scale method are arranged together at the end of one frame to form a binary code sub-frame region. In this case, the sub-frame SF10 adjacent to the binary code sub-frame region is driven like the sub-frame SF4 in FIG. 2. That is, every time the binary code sub-frames SF1 to SF3 are turned from an all-lighting state to an all-non-lighting state, the sub-frame SF10 is turned from a non-lighting state to a lighting state.

As a third pattern, sub-frames appear in the order of SF4, SF5, SF6, SF7, SF1, SF2, SF3, SF9, SF10, and SF8. The sub-frames SF1 to SF3 using a binary code time gray scale method are arranged together at the middle of one frame to form a binary code sub-frame region. In this case, since there are two overlapping sub-frames SF7 and SF9 adjacent to the binary code sub-frame region, any of the two sub-frames SF7 and SF9 may be driven like the sub-frame SF4 in FIG. 2. That is, every time the binary code sub-frames SF1 to SF3 are turned from an all-lighting state to an all-non-lighting state, the sub-frame SF7 or SF9 is turned from a non-lighting state to a lighting state.

As a fourth pattern, sub-frames appear in the order of SF4, SF5, SF1, SF6, SF7, SF2, SF8, SF9, SF3, and SF10. The sub-frames SF4 to SF10 using an overlapping time gray scale method are sequentially arranged, and the sub-frames SF1 to SF3 using a binary code time gray scale method are also sequentially arranged. Further, after two sub-frames using an overlapping time gray scale method are arranged, one sub-frame using a binary code time gray scale method is arranged. The binary code sub-frames SF1 to SF3 are separately arranged in one frame, and accordingly, in a binary code sub-frame region, binary code sub-frames are not arranged together. In this case, any of the overlapping sub-frames SF9 and SF10, which are adjacent to the sub-frame SF3 having the largest weighting among the binary code sub-frames, may be driven like the sub-frame SF4 in FIG. 2.

As a fifth pattern, sub-frames appear in the order of SF4, SF5, SF2, SF6, SF7, SF1, SF8, SF9, SF3, and SF10. This pattern is different from the fourth pattern in that the sub-frames using a binary code time gray scale method are arranged at random. Also in this case, any of the overlapping sub-frames SF9 and SF10, which are adjacent to the sub-frame SF3 having the largest weighting among the binary code sub-frames, may be driven like the sub-frame SF4 in FIG. 2.

As a sixth pattern, sub-frames appear in the order of SF4, SF8, SF1, SF5, SF10, SF2, SF6, SF9, SF3, and SF7. This pattern is different from the fourth pattern in that the sub-frames using an overlapping time gray scale method are arranged at random. In this case, any of the overlapping sub-frames SF9 and SF7, which are adjacent to the sub-frame SF3 having the largest weighting among the binary code sub-frames, may be driven like the sub-frame SF4 in FIG. 2.

As a seventh pattern, sub-frames appear in the order of SF4, SF8, SF2, SF5, SF10, SF1, SF6, SF9, SF3, and SF7. This pattern is different from the fourth pattern in that the sub-frames using an overlapping time gray scale method and the sub-frames using a binary code time gray scale method are arranged at random. Also in this case, any of the overlapping sub-frames SF9 and SF7, which are adjacent to the sub-frame SF3 having the largest weighting among the binary code sub-frames, may be driven like the sub-frame SF4 in FIG. 2.

As an eighth pattern, sub-frames appear in the order of SF4, SF5, SF1, SF6, SF2, SF7, SF8, SF9, SF3, and SF10. This pattern is formed in the following manner: after two sub-frames using an overlapping time gray scale method are arranged, one sub-frame using a binary code time gray scale method is arranged, one sub-frame using an overlapping time gray scale method is arranged, one sub-frame using a binary code time gray scale method is arranged, three sub-frames using an overlapping time gray scale method are arranged, and one additive sub-frame is arranged. In this case, any of overlapping sub-frames SF9 and SF10, which are adjacent to the sub-frame SF3 having the largest weighting among the binary code sub-frames, may be driven like the sub-frame SF4 in FIG. 2.

As a ninth pattern, sub-frames appear in the order of SF4, SF5, SF6, SF7, SF1, SF2, SF8, SF9, SF10, and SF3. This pattern is formed in the following manner: after four sub-frames using an overlapping time gray scale method are arranged, two sub-frames using a binary code time gray scale method are arranged, three sub-frames using an overlapping time gray scale method are arranged, and one sub-frame using a binary code time gray scale method is arranged. In this case, the overlapping sub-frame SF10, which is adjacent to the sub-frame SF3 having the largest weighting among the binary code sub-frames, may be driven like the sub-frame SF4 in FIG. 2.

In such a manner, it is desirable to arrange the sub-frames using a binary code time gray scale method among the sub-frames using an overlapping time gray scale method so that the sub-frames are evenly arranged. Consequently, pseudo contours can be reduced because of trick of eyesight.

It is to be noted that the order in which sub-frames appear may be changed. For example, the order of appearance of sub-frames may be changed between the first frame and the second frame. In addition, the order of appearance of sub-frames may be changed depending on a position.

It is to be noted that, although a frame frequency of 60 Hz is generally used, the present invention is not limited thereto. Pseudo contours may be reduced by increasing the frame frequency. For example, a display device may be operated at approximately 120 Hz that is twice as high as the normal frequency.

Embodiment Mode 2

In this embodiment mode, an example of a timing chart will be described. Although FIG. 1 is used as an example of a selecting method of sub-frames, the present invention is not limited thereto, and can easily be applied to other selecting method of sub-frames, other numbers of gray scales, or the like.

In addition, although the order in which sub-frames appear is SF1, SF2, SF3, SF4, SF5, and SF6 as an example, the present invention is not limited thereto and can easily be applied to other orders.

FIG. 16 shows a timing chart in a case where a period where signals are written to a pixel and a period where a pixel is lighted are separated. First, signals for one screen are inputted to all pixels in a signal-writing period. During this period, pixels are not lighted. After the signal-writing period, a lighting period starts and pixels are lighted. The length of the lighting period at this time is 1. Next, a subsequent sub-frame starts and signals for one screen are inputted to all pixels in a signal-writing period. During this period, pixels are not lighted. After the signal-writing period, a lighting period starts and pixels are lighted. The length of the lighting period at this time is 2.

By repeating similar operations, the lengths of the lighting periods are arranged in the order of 4, 4, 4, 16, 1, and 2.

Such a driving method where a period where a signal is written to a pixel and a period where a pixel is lighted are separated is preferably applied to a plasma display. It is to be noted that, in the case where the driving method is used for a plasma display, an initialization operation or the like are required, which are omitted here for simplicity.

Moreover, this driving method is also preferably applied to an organic EL display, a field emission display, a display using a digital micromirror device (DMD), or the like.

Figure 17:
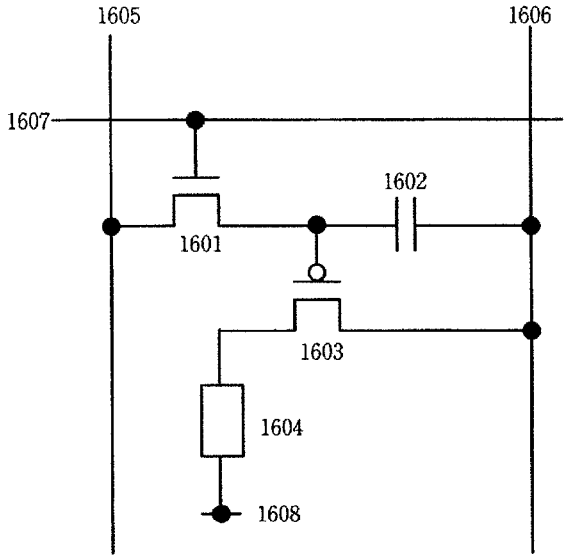
FIG. 17 is a diagram explaining a configuration of a display device of the present invention.

FIG. 17 shows a pixel configuration of this case. A gate line 1607 is selected to turn a selecting transistor 1603 on, and a signal is inputted from a signal line 1605 to a storage capacitor 1602. Then, a current flowing through the driving transistor 1603 is controlled depending on the signal, and a current flows from a first power supply line 1606 to a second power supply line 1608 through a display element 1604.

It is to be noted that, in a signal-writing period, each potential of the first power supply line 1606 and the second power supply line 1608 are controlled so that no voltage is applied to the display element 1604. Consequently, the display element 1604 can be prevented from lighting in a signal-writing period.

Figure 18:
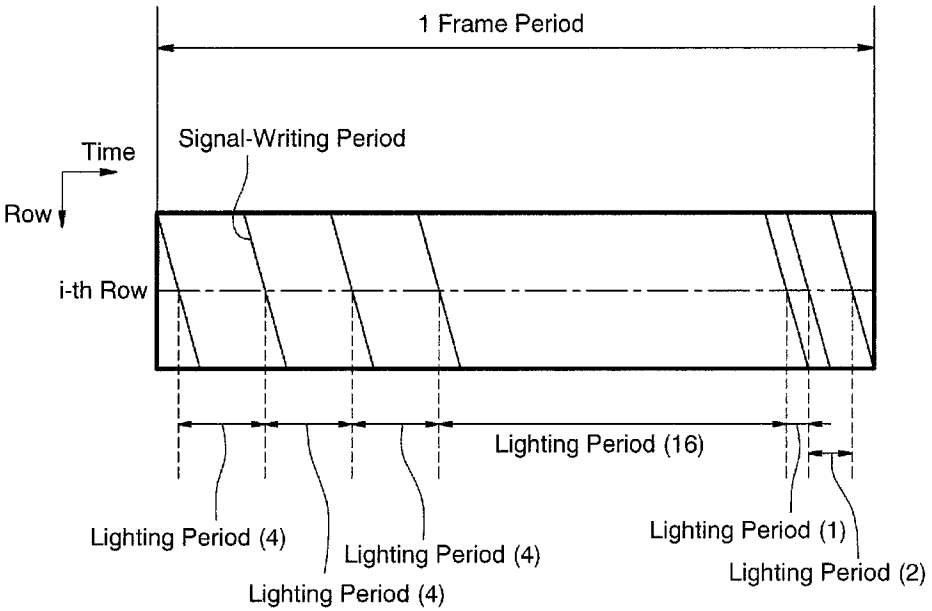
FIG. 18 is a diagram explaining a structure of a driving method of a display device of the present invention.

Next, FIG. 18 shows a timing chart in a case where a period where a signal is written to a pixel and a period where a pixel is lighted are not separated. Immediately after a signal is written to each row, a lighting period starts.

In a certain row, after writing of signals and a predetermined lighting period are finished, a signal writing operation starts in a subsequent sub-frame. By repeating such operations, the lengths of the lighting periods are arranged in the order of 4, 4, 4, 16, 1, and 2.

In such a manner, many sub-frames can be arranged in one frame even if signals are written slowly.

Such a driving method is preferably applied to a plasma display. It is to be noted that, in the case where the driving method is used for a plasma display, an initialization operation or the like are required; however, explanation thereof is omitted here.

In addition, this driving method is also preferably applied to a light emitting device such as an organic EL display, an inorganic EL display, a plasma display, a field emission display (FED), or a surface-conduction electron-emitter display (SED); a reflection type display device such as a digital micromirror device (DMD), a grating light valve (GLV), or a reflection type liquid crystal display; or a liquid crystal display device such as a ferroelectric liquid crystal display or an anti-ferroelectric liquid crystal display.

Figure 19:
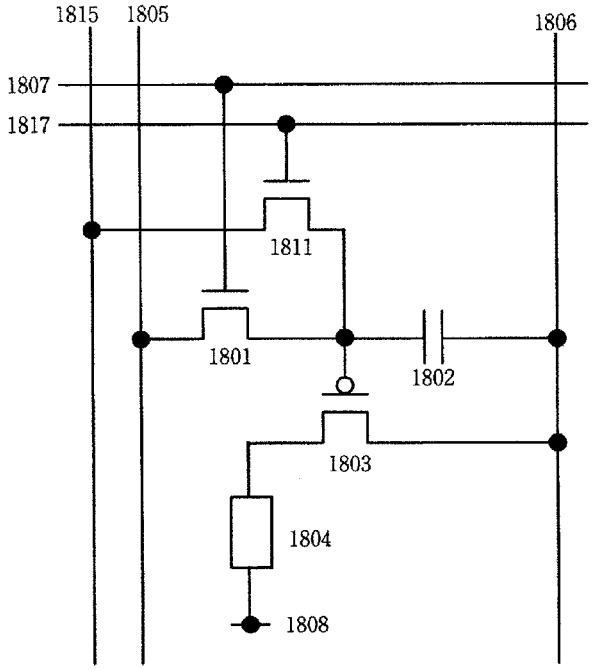
FIG. 19 is a diagram explaining a configuration of a display device of the present invention.

FIG. 19 shows an example of a pixel configuration. A first gate line 1807 is selected to turn a first selecting transistor 1801 on, and a signal is inputted from a first signal line 1805 to a storage capacitor 1802. Then, a current flowing through a driving transistor 1803 is controlled depending on the signal, and a current flows from a first power supply line 1806 to a second power supply line 1808 through a display element 1804. In the same manner, a second gate line 1817 is selected to turn a second selecting transistor 1811 on, and a signal is inputted from a second signal line 1815 to the storage capacitor 1802. Then, a current flowing through the driving transistor 1803 is controlled depending on the signal, and a current flows from the first power supply line 1806 to the second power supply line 1808 through the display element 1804.

The first gate line 1807 and the second gate line 1817 can be controlled separately. In the same manner, the first signal line 1805 and the second signal line 1815 can be controlled separately. Accordingly, signals can be inputted to pixels of two rows at the same time; thus, the driving method as shown in FIG. 18 can be achieved.

Figure 20:
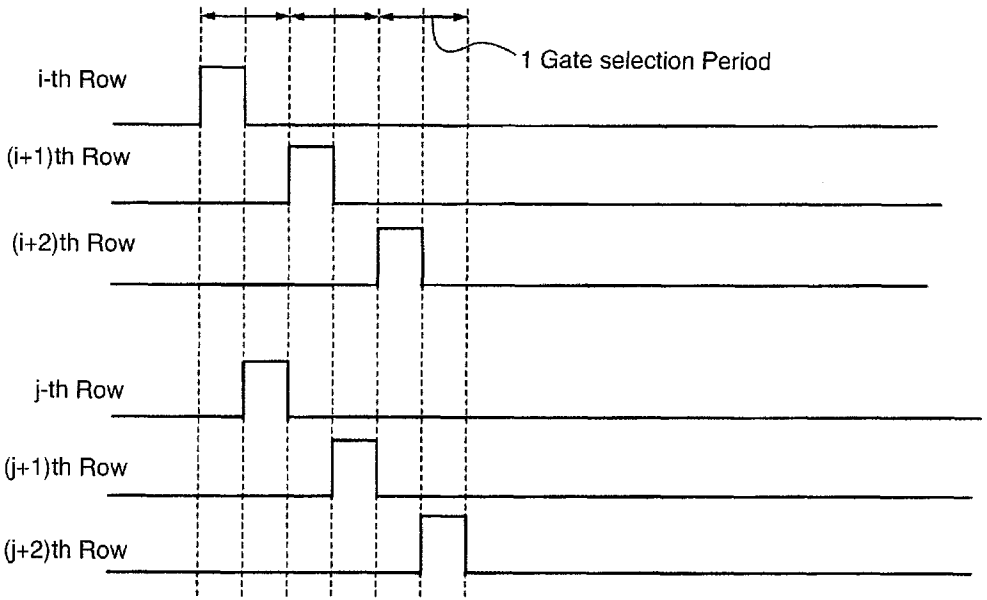
FIG. 20 is a diagram explaining a configuration of a driving method of a display device of the present invention.

It is to be noted that the driving method as shown in FIG. 18 can also be achieved using the circuit of FIG. 17. FIG. 20 shows a timing chart of this case. As shown in FIG. 20, one gate selection period is divided into a plurality of periods (two in FIG. 20). Each gate line is selected in each of the divided selection periods and a corresponding signal is inputted to the signal line 1605. For example, in one gate selection period, the i-th row is selected in the first half of the period and the j-th row is selected in the latter half of the period. Accordingly, an operation can be performed as if the two rows are selected at the same time in the one gate selection period.

It is to be noted that such a driving method is applicable in combination with the present invention.

Figure 21:
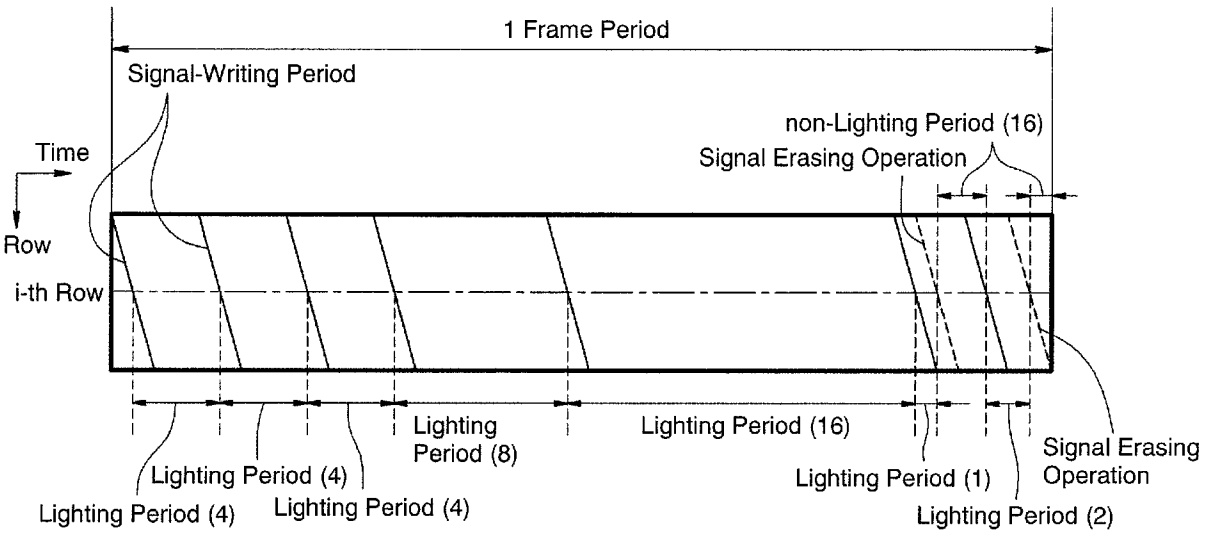
FIG. 21 is a diagram explaining a structure of a display device of the present invention.

Then, FIG. 21 shows a timing chart in a case where signals in pixels are erased. In each row, a signal writing operation is performed and the signals in the pixels are erased before a subsequent signal writing operation. Accordingly, the length of a lighting period can easily be controlled.

In a certain row, after writing of signals and a predetermined lighting period are finished, a signal writing operation starts in a subsequent sub-frame. In the case where a lighting period is short, a signal erasing operation is performed to provide a non-lighting state. By repeating such operations, the lengths of the lighting periods are arranged in the order of 4, 4, 4, 16, 1, and 2.

It is to be noted that, although the signal erasing operation is performed in the case where the lighting periods are 1 and 2 in FIG. 21, the present invention is not limited thereto. The erasing operation may be performed in other lighting periods.

Accordingly, many sub-frames can be arranged in one frame even if signals are written slowly. In addition, in the case of performing the signal erasing operation, data for erasing is not required to be obtained as well as a video signal; therefore, the driving frequency of a source driver can also be reduced.

Such a driving method is preferably applied to a plasma display. It is to be noted that, in the case where the driving method is used for a plasma display, an initialization operation and the like are required, which are omitted here for simplicity.

In addition, this driving method is also preferably applied to an organic EL display, a field emission display, a display using a digital micromirror device (DMD), or the like.

Figure 22:
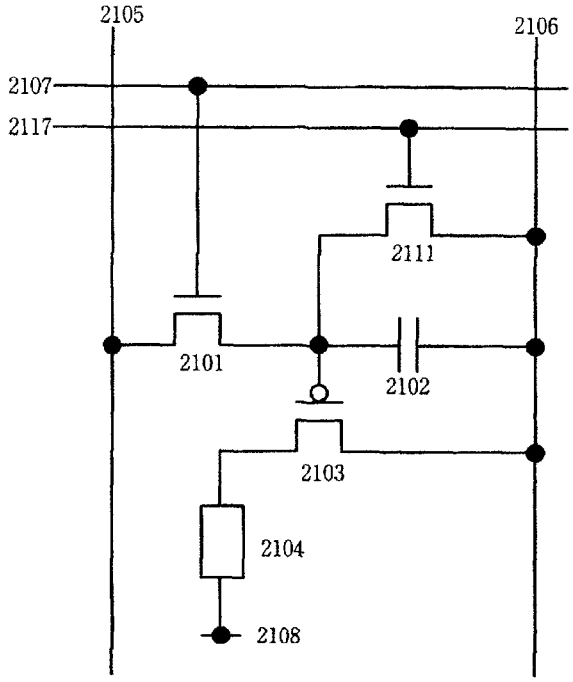
FIG. 22 is a diagram explaining a configuration of a display device of the present invention.

FIG. 22 shows a pixel configuration of this case. A first gate line 2107 is selected to turn a selecting transistor 2101 on, and a signal is inputted from a signal line 2105 to a storage capacitor 2102. Then, a current flowing through a driving transistor 2103 is controlled depending on the signal, and a current flows from a first power supply line 2106 to a second power supply line 2108 through a display element 2104.

In order to erase a signal, a second gate line 2117 is selected to turn an erasing transistor 2111 on, so that the driving transistor 2103 is turned off. Then, no current flows from the first power supply line 2106 to the second power supply line 2108 through the display element 2104. Consequently, a non-lighting period can be provided and the length of a lighting period can be freely controlled.

Although the erasing transistor 2111 is used in FIG. 22, another method can be used. This is because a non-lighting period may forcibly be provided so that no current is supplied to the display element 2104. Therefore, a non-lighting period may be provided by arranging a switch in a path where a current flows from the first power supply line 2106 to the second power supply line 2108 through the display element 2104 and controlling on/off of the switch. Alternatively, a gate-source voltage of the driving transistor 2103 may be controlled to forcibly turn the driving transistor off.

Figure 23:
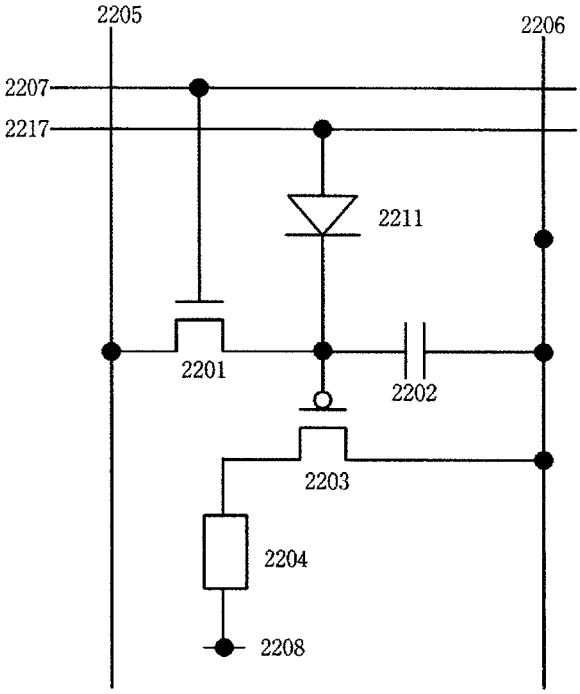
FIG. 23 is a diagram explaining a configuration of a display device of the present invention.

FIG. 23 shows an example of a pixel configuration in the case where a driving transistor is forcibly turned off. A selecting transistor 2201, a driving transistor 2203, an erasing diode 2211, and a display element 2204 are provided. Each of a source and a drain of the selecting transistor 2201 is connected to a signal line 2205 and a gate of the driving transistor 2203. A gate of the selecting transistor 2201 is connected to a first gate line 2107. A source and a drain of the driving transistor 2203 are connected to a first power supply line 2206 and the display element 2204. The erasing diode 2211 is connected to the gate of the driving transistor 2203 and a second gate line 2217.

A storage capacitor 2202 has a function of holding gate potential of the driving transistor 2203. Thus, although the storage capacitor 2202 is connected between the gate of the driving transistor 2203 and the first power supply line 2206, the present invention is not limited thereto. The storage capacitor 2202 may be arranged to hold the gate potential of the driving transistor 2203. In addition, in the case where the gate potential of the driving transistor 2203 can be held using the gate capacitance of the driving transistor 2203, or the like, the storage capacitor 2202 may be omitted.

As an operating method, the first gate line 2207 is selected to turn the selecting transistor 2201 on, and a signal is inputted from the signal line 2205 to the storage capacitor 2202. Then, a current flowing through the driving transistor 2203 is controlled depending on the signal, and a current flows from the first power supply line 2106 to a second power supply line 2108 through the display element 2104.

In order to erase a signal, the second gate line 2117 is selected (supplied with high potential here) to turn the erasing diode 2211 on, so that a current flows from the second gate line 2117 to the gate of the driving transistor 2203. Consequently, the driving transistor 2203 is turned off. Then, no current flows from the first power supply line 2206 to the second power supply line 2208 through the display element 2204. Consequently, a non-lighting period can be provided and the length of a lighting period can be freely controlled.

In order to hold a signal, the second gate line 2117 is not selected (supplied with low potential here). Then, the erasing diode 2211 is turned off and the gate potential of the driving transistor 2203 is thus held.

It is to be noted that the erasing diode 2211 may be any element as far as it has rectifying properties. The erasing diode may be a PN diode, a PIN diode, a Schottky diode, or a zener diode.

Figure 24:
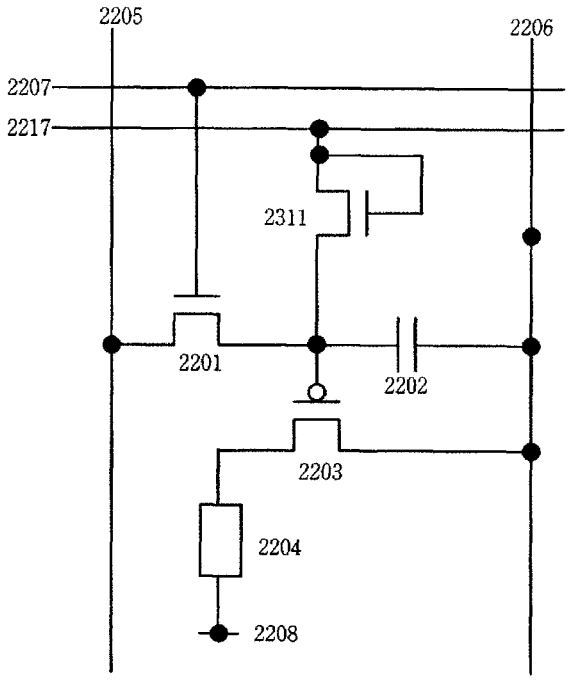
FIG. 24 is a diagram explaining a configuration of a display device of the present invention.

In addition, a diode-connected transistor (a gate and a drain thereof are connected) may be used as well by using a transistor. A circuit diagram of this case is shown in FIG. 24. As the erasing diode 2211, a diode-connected transistor 2311 is used. Although an N-channel transistor is used here, the present invention is not limited thereto and a P-channel transistor may also be used.

It is to be noted that a driving method as shown in FIG. 21 can be achieved using the circuit in FIG. 17 as still another circuit. FIG. 20 shows a timing chart of this case. As shown in FIG. 20, one gate selection period is divided into a plurality of periods (two in FIG. 20). Each gate line is selected in each of the divided selection periods and a corresponding signal (a video signal and an erasing signal) is inputted to the signal line 1605. For example, in certain one gate selection period, the i-th row is selected in the first half of the period and the j-th row is selected in the latter half of the period. Then, when the i-th row is selected, a video signal for it is inputted. On the other hand, when the j-th row is selected, a signal for turning the driving transistor off is inputted. Accordingly, an operation can be performed as if the two rows are selected at the same time in the one gate selection period.

It is to be noted that such a driving method is applicable in combination with the present invention.

It is to be noted that the timing charts, pixel configurations, and driving methods that are shown in this embodiment mode are examples and the present invention is not limited thereto. The present invention is applicable to various timing charts, pixel configurations, and driving methods.

It is to be noted that the order in which sub-frames appear may be changed depending on time. For example, the order in which sub-frames appear may be changed between the first frame and the second frame. Further, the order in which sub-frames appear may be changed depending on position. For example, the order in which sub-frames appear may be changed between the pixel A and the pixel B. Further, the order in which sub-frames appear may be changed depending on time and position by combining these.

It is to be noted that a lighting period, a signal writing period, and a non-lighting period are arranged in one frame period in this embodiment mode; however, the present invention is not limited thereto and other operation periods may also be arranged. For example, a period where a voltage of opposite polarity to normal polarity is applied to a display element, a so-called reverse bias period may be provided. By providing the reverse bias period, the reliability of the display element is improved in some cases.

It is to be noted that the present invention is not limited to the pixel configurations described in this embodiment mode. Other configurations having the same function are applicable as well.

It is to be noted that the details described in this embodiment mode can be implemented by freely combining with the details described in Embodiment Mode 1.

Embodiment Mode 3

In this embodiment mode, an example of a display device using a driving method of the present invention will be described.

As a typical display device, a plasma display can be given. A pixel of a plasma display can be only in a light-emitting state or a non-light-emitting state. Accordingly, a time gray scale method is used as one of the means for achieving multiple gray scales. Therefore, the present invention is applicable thereto.

It is to be noted that, in a plasma display, initialization of a pixel is required as well as writing of a signal to a pixel. Therefore, it is desirable that sub-frames be sequentially arranged in the portion where the overlapping time gray scale method is used, and sub-frames using the binary code time gray scale method not be sandwiched therebetween. By thus arranging the sub-frames, the number of times of initialization of a pixel can be reduced. As a result, the contrast can be improved.

When sub-frames using the binary code time gray scale method are arranged together, however, this portion causes pseudo contours. Accordingly, sub-frames using the binary code time gray scale method are desirably arranged as separately as possible in one frame. In the case of using sub-frames using the binary code time gray scale method, initialization of a pixel is necessary to be performed corresponding to each sub-frame. Therefore, it is not a major problem that sub-frames using the binary code time gray scale method are arranged separately. On the other hand, in the case of sub-frames using the overlapping time gray scale method, initialization of a pixel is not necessary to be performed if lighting sub-frames are arranged in series. Thus, the sub-frames are desirably arranged as sequentially as possible.

Accordingly, in a case of combining sub-frames using the overlapping time gray scale method and sub-frames using the binary code time gray scale method, as the order in which sub-frames appear, the sub-frames using the overlapping time gray scale method are desirably arranged so that sub-frames where light is emitted are arranged in series, and the sub-frames using the binary code time gray scale method are desirably arranged separately between the sub-frames using the overlapping time gray scale method. Accordingly, the number of times of initialization can be reduced, the contrast can be improved, and pseudo contours can be reduced.

As examples of a display device other than a plasma display, an organic EL display, a field emission display, a display using a digital micromirror device (DMD), a ferroelectric liquid crystal display, a bistable liquid crystal display, or the like are given. All of them are display devices to which the time gray scale method is applicable. Pseudo contours can be reduced by applying the present invention to these display devices with the use of the time gray scale method.

For example, in the case of an organic EL display, initialization of a pixel is not required. Therefore, reduction in contrast, which is caused by light emission in initialization of a pixel, does not occur. Accordingly, the order in which sub-frames appear can be set arbitrarily. Sub-frames are desirably arranged separately so as to reduce pseudo contours as much as possible.

Therefore, sub-frames using the overlapping time gray scale method may be arranged so that lighting sub-frames are arranged in series, and sub-frames using the binary code time gray scale method may be separately arranged between the sub-frames using the overlapping time gray scale method. Accordingly, the sub-frames using the overlapping time gray scale method are arranged together in one frame to some degree; therefore, pseudo contours can be reduced, which occur in a boundary between the first frame and the second frame. So-called moving image pseudo contours can be reduced. In addition, since the sub-frames using the binary code time gray scale method are separately arranged, pseudo contours can be reduced.

Alternatively, sub-frames using the overlapping time gray scale method may be arranged separately, and sub-frames using the binary code time gray scale method may also be arranged separately. Consequently, pseudo contours caused by the portions using the binary code time gray scale method are mixed with the sub-frames using the overlapping time gray scale method; therefore, the effect of reducing pseudo contours increases as a whole.

It is to be noted that the details described in this embodiment mode can be implemented by freely combining with the details described in Embodiment Modes 1 to 2.

Embodiment Mode 4

In this embodiment mode, a configuration and an operation of a display device, a signal line driver circuit, and a gate line driver circuit will be explained.

Figure 25:
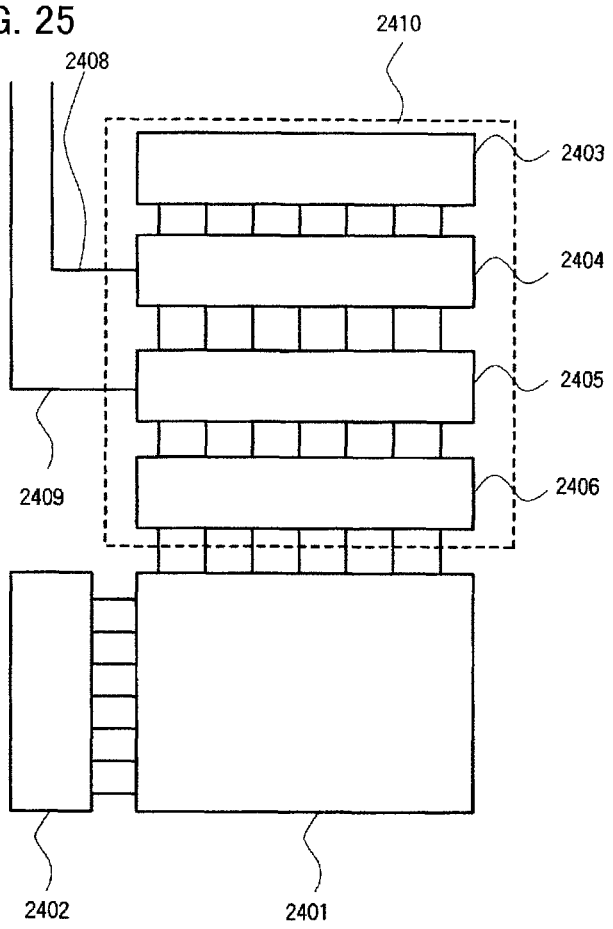
FIG. 25 is a diagram explaining a configuration of a display device of the present invention.

As shown in FIG. 25, a display device has a pixel array 2401, a gate line driver circuit 2402, and a signal line driver circuit 2410. The gate line driver circuit 2402 sequentially outputs a selection signal to the pixel array 2401. The gate line driver circuit 2402 includes a shift register, a buffer circuit, and the like.

Besides, the gate line driver circuit 2402 often includes a level shifter circuit, a pulse width controlling circuit, and the like. The signal line driver circuit 2410 sequentially outputs a video signal to the pixel array 2401. The shift register 2403 outputs a pulse to select a gate line sequentially. In the pixel array 2401, images are displayed by controlling a state of light in accordance with the video signal. The video signal inputted from the signal line driver circuit 2410 to the pixel array 2401 is often a voltage. In other words, states of a display element arranged in each pixel and an element controlling the display element are changed by the video signal (voltage) inputted from the signal line driver circuit 2410. As examples of a display element arranged in a pixel, an EL element, an element used for an FED (Field Emission Display), a liquid crystal, a DMD (digital micromirror device), or the like can be given.

It is to be noted that the gate line driver circuit 2402 and the signal line driver circuit 2410 may be arranged in plural.

The configuration of the signal line driver circuit 2410 can be divided into a plurality of portions. As an example, the signal line driver circuit 2410 can be roughly divided into the shift register 2403, a first latch circuit (LAT1) 2404, a second latch circuit (LAT2) 2405, and an amplifier circuit 2406. The amplifier circuit 2406 may have a function of converting a digital signal into an analog signal or a function of performing a gamma correction.

In addition, a pixel has a display element such as an EL element. A circuit for outputting current (a video signal) to the display element, that is, a current source circuit may be provided in some cases.

Thus, an operation of the signal line driver circuit 2410 will be briefly described. A clock signal (S-CLK), a start pulse (SP), and an inverted clock signal (S-CLKb) are inputted to the shift register 2403, and a sampling pulse is sequentially outputted in accordance with the timing of these signals.

The sampling pulse outputted from the shift register 2403 is inputted to the first latch circuit (LAT1) 2404. A video signal is inputted from a video signal line 2408 to the first latch circuit (LAT1) 2404. The first latch circuit (LAT1) 2404 holds a video signal of each column in accordance with the timing at which the sampling pulse is inputted.

After holding of video signals is completed to the last column in the first latch circuit (LAT1) 2404, a latch pulse (Latch Pulse) is inputted from a latch control line 2409 during a horizontal retrace period, and the video signals held in the first latch circuit (LAT1) 2404 are transferred to the second latch circuit (LAT2) 2405 at once. After that, the video signals of one row, which are held in the second latch circuit (LAT2) 2405, are inputted to the amplifier circuit 2406 at once. A signal outputted from the amplifier circuit 2406 is inputted to the pixel array 2401.

While the video signal held in the second latch circuit (LAT2) 2405 is inputted to the amplifier circuit 2406 and then inputted to the pixel array 2401, a sampling pulse is outputted from the shift register 2403 again. In other words, two operations are performed at the same time. Accordingly, a line sequential driving can be enabled. These operations are repeated thereafter.

It is to be noted that the signal line driver circuit or part thereof (the current source circuit, the amplifier circuit, or the like) may be constituted using, for example, an external IC chip in some cases instead of being provided over the same substrate as the pixel array 2401.

Figure 26:
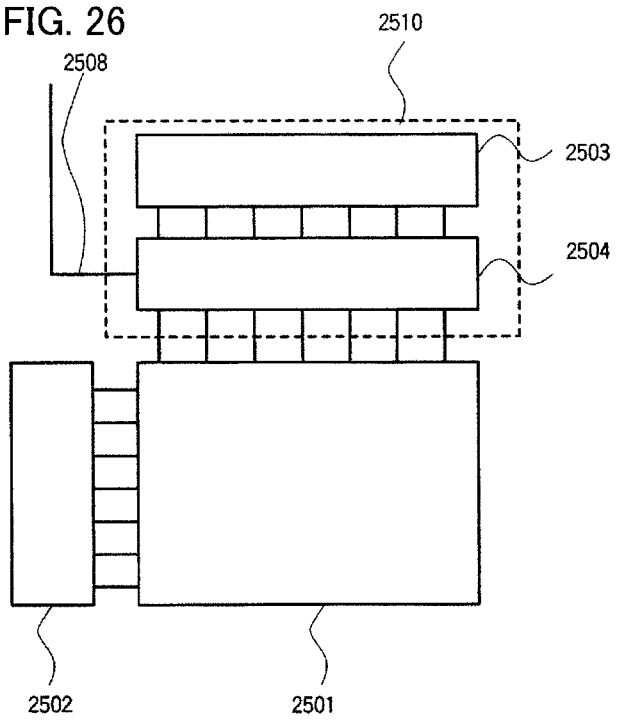
FIG. 26 is a diagram explaining a configuration of a display device of the present invention.

It is to be noted that the configuration of the signal line driver circuit, the gate line driver circuit, and the like is not limited to that in FIG. 25. For example, a signal is supplied to a pixel by a dot sequential driving in some cases. FIG. 26 shows an example of a signal line driver circuit 2510 of that case. A sampling pulse is outputted from a shift register 2503 to a sampling circuit 2504. A video signal is inputted from a video signal line 2508, and the video signal is outputted to a pixel 2501 depending on the sampling pulse.

It is to be noted that, as described above, a transistor of the present invention may be any type of transistors, and formed over any substrate. Therefore, the circuits shown in FIGS. 25 and 26 may all be formed over a glass substrate, a plastic substrate, a single crystalline substrate, an SOI substrate, or any substrate. Alternatively, part of the circuits in FIGS. 25 and 26 may be formed over one substrate, and the other part of the circuits in FIGS. 25 and 26 may be formed over another substrate. In other words, the whole circuits in FIGS. 25 and 26 are not necessarily formed over the same substrate. For example, in FIGS. 25 and 26, the pixel array 2401 and the gate line driver circuit 2402 may be formed over a glass substrate using TFTs, and the signal line driver circuit 2410 (or part thereof) may be formed over a single crystalline substrate, and then an IC chip thereof may be connected by COG (Chip On Glass) to be provided over a glass substrate. Alternatively, the IC chip may be connected to the glass substrate by TAB (Tape Auto Bonding) or using a printed wiring board.

It is to be noted that the details described in this embodiment mode utilize the details described in Embodiment Modes 1 to 3. Therefore, the details described in Embodiment Modes 1 to 3 can also be applied to this embodiment mode.

Embodiment Mode 5

Figure 27:
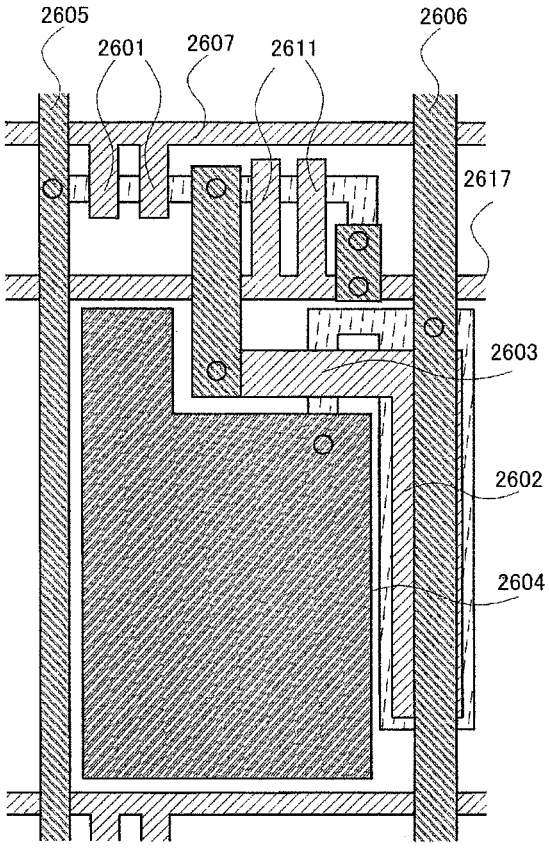
FIG. 27 is a diagram explaining a configuration of a display device of the present invention.

Next, a layout of a pixel in a display device of the present invention will be described. As an example, a layout diagram of the circuit diagram shown in FIG. 24 is shown in FIG. 27. It is to be noted that the circuit diagram and the layout diagram are not limited to FIGS. 24 and 27.

A selecting transistor 2601, a driving transistor 2603, an erasing transistor 2611, and a power source of a display element 2604 are arranged. A source and a drain of the selecting transistor 2601 are connected to a signal line 2605 and a gate of the driving transistor 2603. A gate of the selecting transistor 2601 is connected to a first gate line 2107. A source and a drain of the driving transistor 2603 are connected to a power supply line 2606 and the display element 2604, respectively. The diode-connected erasing transistor 2611 is connected to the gate of the driving transistor 2603 and a second gate line 2617. A storage capacitor 2602 is connected between the gate of the driving transistor 2603 and the power supply line 2606.

The signal line 2605 and the power supply line 2606 are each formed of a second wiring, whereas the first gate line 2107 and the second gate line 2617 are each formed of a first wiring.

In a case of a top gate structure, films are formed in the order of a substrate, a semiconductor layer, a gate insulating film, a first wiring serving as a gate electrode, an interlayer insulating film, and a second wiring serving as a source electrode and a drain electrode. In a case of a bottom gate structure, films are formed in the order of a substrate, a first wiring serving as a gate electrode, a gate insulating film, a semiconductor layer, an interlayer insulating film, and a second wiring serving as a source electrode and a drain electrode.

It is to be noted that the details described in this embodiment mode can be implemented by freely combining with the details described in Embodiment Modes 1 to 4.

Embodiment Mode 6

Hardware for controlling the driving method described in Embodiment Modes 1 to 5 will be described in this embodiment mode.

Figure 28:
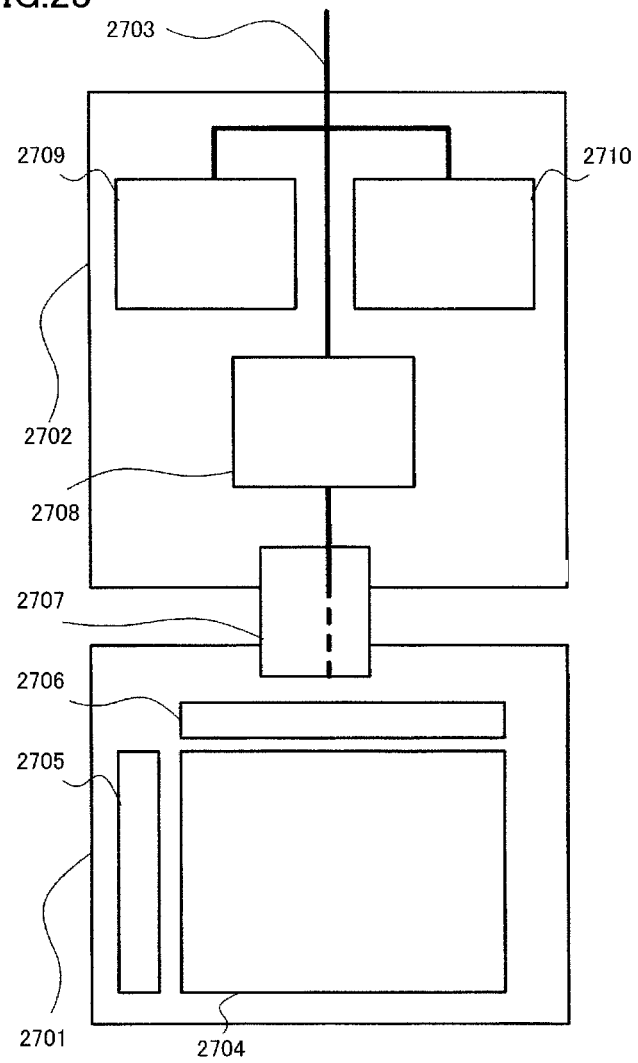
FIG. 28 is a diagram explaining a configuration of a display device of the present invention.

FIG. 28 shows a general configuration diagram. A pixel array 2704 is arranged over a substrate 2701. A signal line driver circuit 2706 and a gate line driver circuit 2705 are arranged in many cases. Besides, a power supply circuit, a precharge circuit, a timing generating circuit, or the like may be arranged. There are some cases where the signal line driver circuit 2706 or the gate line driver circuit 2705 are not arranged. In that case, circuits that are not arranged over the substrate 2701 are formed over an IC in many cases. The IC is arranged over the substrate 2701 by COG (Chip On Glass) in many cases. Alternatively, the IC may be arranged over a connecting substrate 2707 that connects the substrate 2701 to a peripheral circuit substrate 2702.

A signal 2703 is inputted to the peripheral circuit substrate 2702. Then, the signal is held in a memory 2709, a memory 2710, or the like by the control of a controller 2708. In a case where the signal 2703 is an analog signal, the signal 2703 is often analog-to-digital converted to be held in the memory 2709, the memory 2710, or the like. Then, the controller 2708 outputs a signal to the substrate 2701 by using the signal held in the memory 2709, the memory 2710, or the like.

In order to achieve the driving method described in Embodiment Mode 1 to Embodiment Mode 5, the controller 2708 outputs a signal to the substrate 2701 by controlling the order in which sub-frames appear, or the like.

It is to be noted that the details described in this embodiment mode can be implemented by freely combining with the details described in Embodiment Modes 1 to 5.

Embodiment Mode 7

Figure 29:
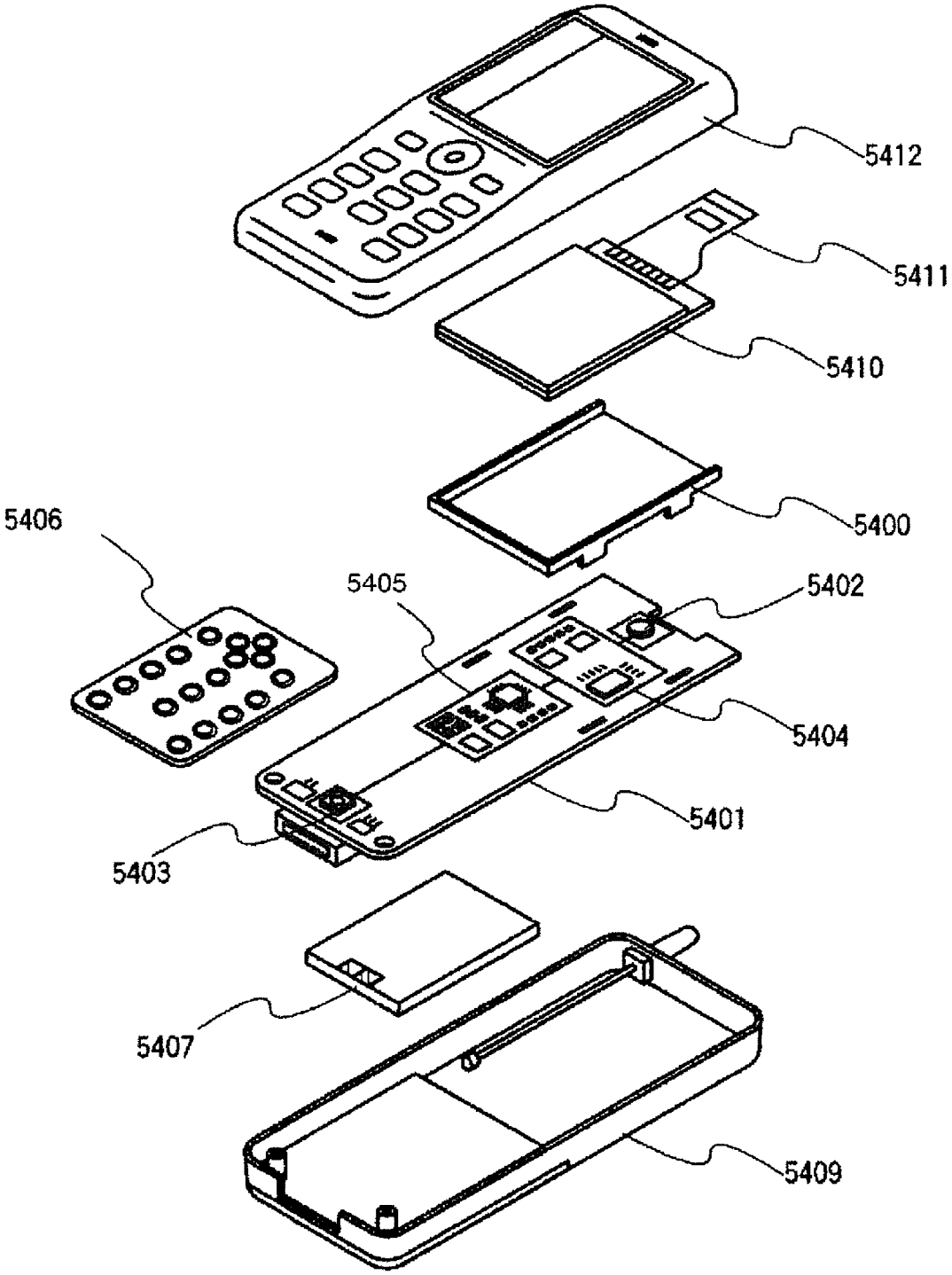
FIG. 29 is a view explaining an electronic device to which the present invention is applied.

A configuration example of a cellular phone having a display portion that is formed using a display device of the present invention or a display device using a driving method thereof will be explained with reference to FIG. 29.

A display panel 5410 is incorporated in a housing 5400 so as to be freely attached and detached. The shape and the size of the housing 5400 can be appropriately changed in accordance with the size of the display panel 5410. The housing 5400 to which the display panel 5410 is fixed is fitted in a printed wiring board 5401 so as to be constructed as a module.

The display panel 5410 is connected to the printed wiring board 5401 through an FPC 5411. A signal processing circuit 5405 including a speaker 5402, a microphone 5403, a transmitting/receiving circuit 5404, a CPU, a controller, and the like is formed over the printed wiring board 5401. Such a module, an input means 5406, and a battery 5407 are combined to be incorporated in housings 5409 and 5412. A pixel portion of the display panel 5410 is arranged to be seen from an opening window of the housing 5412.

In the display panel 5410, a pixel portion and part of peripheral driver circuits (a driver circuit with a lower operating frequency among a plurality of driver circuits) may be integrated over a substrate using TFTs, and another part of the peripheral driver circuits (a driver circuit with a higher operating frequency among the plurality of driver circuits) may be formed over an IC chip, and then the IC chip may be mounted on the display panel 5410 by COG (Chip On Glass). Alternatively, the IC chip may be connected to a wiring formed over a glass substrate by TAB (Tape Auto Bonding) or using a printed wiring board. It is to be noted that FIG. 30A shows an example of a configuration of a display panel where part of peripheral driver circuits and a pixel portion are integrated over a substrate and an IC chip including the other peripheral driver circuits is mounted by COG or the like. It is to be noted that a configuration of the display panel in FIG. 30A has a substrate 5300, a signal line driver circuit 5301, a pixel portion 5302, a scanning line driver circuit 5303, a scanning line driver circuit 5304, an FPC 5305, an IC chip 5306, an IC chip 5307, a sealing substrate 5308, and a sealing member 5309. By employing such a configuration, the power consumption of a display device can be lowered and the operating time of a cellular phone by charging once can be extended. In addition, the cost of a cellular phone can be reduced.

Moreover, when a signal that is set for a scanning line or a signal line is impedance-converted by a buffer, a writing time of one row of pixels can be reduced. Therefore, a display device with higher definition can be provided.

Figure 30B:
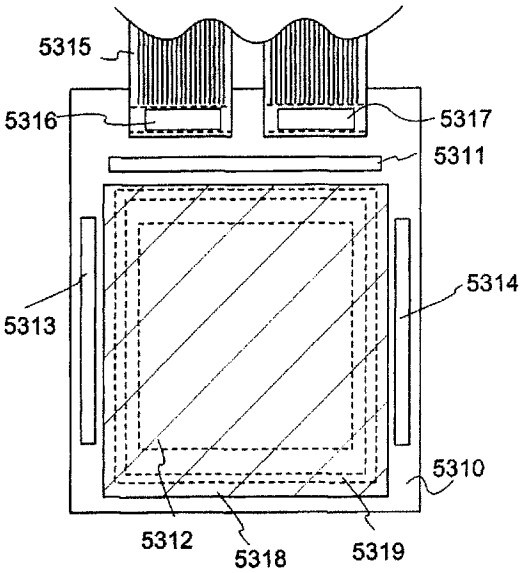
FIGS. 30A and 30B are diagrams each explaining a structure of a display device of the present invention.
Figure 30A:
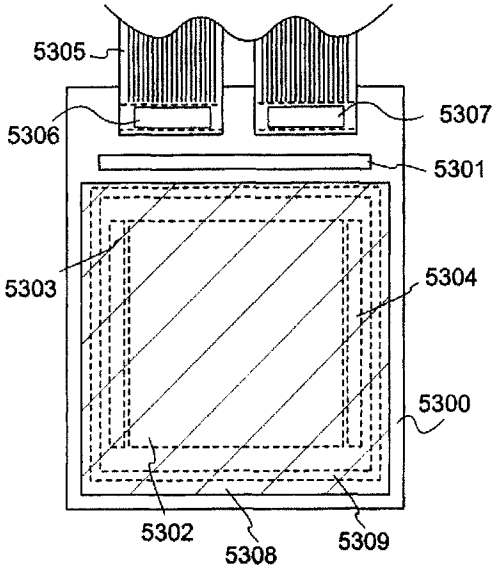

Further, in order to further reduce the power consumption, as shown in FIG. 30B, a pixel portion may be formed over a substrate using TFTs, peripheral driver circuits may all be formed over an IC chip, and then the IC chip may be mounted on a display panel by COG (Chip On Glass) or the like. It is to be noted that a configuration of a display panel in FIG. 30B has a substrate 5310, a signal line driver circuit 5311, a pixel portion 5312, a gate line driver circuit 5313, a scanning line driver circuit 5314, an FPC 5315, an IC chip 5316, an IC chip 5317, a sealing substrate 5318, and a sealing member 5319.

By using the display device of the present invention and the driving method thereof, an image where pseudo contours are reduced can be displayed. Therefore, even an image like human skin where gray scales subtly change can be displayed with pseudo contours reduced.

Furthermore, the configuration shown in this embodiment mode is an example of the cellular phone, and the display device of the present invention is not limited to the cellular phone with such a configuration and is applicable to cellular phones with various configurations.

Embodiment Mode 8

Figure 31:
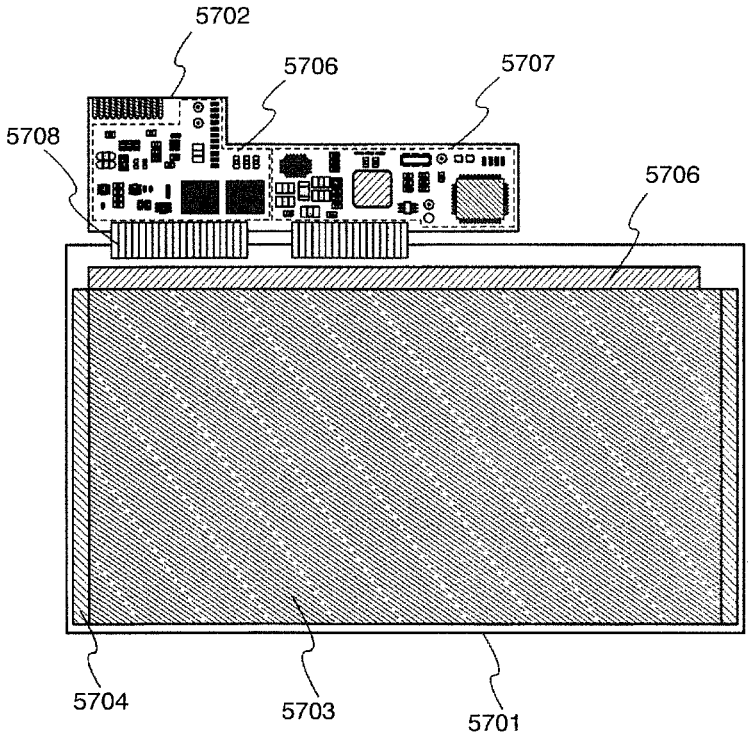
FIG. 31 is a view explaining an electronic device to which the present invention is applied.

FIG. 31 shows an EL module where a display panel 5701 and a circuit substrate 5702 are combined. The display panel 5701 has a pixel portion 5703, a scanning line driver circuit 5704, and a signal line driver circuit 5705. The circuit substrate 5702 includes, for example, a control circuit 5706, a signal division circuit 5707, or the like. The display panel 5701 is connected to the circuit substrate 5702 with a connecting wiring 5708. As the connecting wiring, an FPC or the like may be employed.

The control circuit 5706 corresponds to the controller 2708, the memory 2709, the memory 2710, or the like, which are shown in Embodiment Mode 7. The order in which subframes appear, or the like are controlled mainly by the control circuit 5706.

In the display panel 5701, a pixel portion and part of peripheral driver circuits (a driver circuit with a lower operating frequency among a plurality of driver circuits) may be integrated over a substrate using TFTs, and another part of the peripheral driver circuits (a driver circuit with a higher operating frequency among the plurality of driver circuits) may be formed over an IC chip, and then the IC chip may be mounted on the display panel 5701 by COG (Chip On Glass) or the like. Alternatively, the IC chip may be mounted on the display panel 5701 by TAB (Tape Auto Bonding) or using a printed wiring board. It is to be noted that FIG. 30A shows a configuration example where part of peripheral driver circuits and a pixel portion are integrated over a substrate and an IC chip including the other peripheral driver circuits is mounted by COG or the like. By employing such a configuration, the power consumption of a display device can be lowered and the operating time of a cellular phone by charging once can be extended. In addition, the cost of a cellular phone can be reduced.

In addition, when a signal that is set for a scanning line or a signal line is impedance-converted by a buffer, a writing time of one row of pixels can be reduced. Therefore, a display device with higher definition can be provided.

Moreover, in order to further reduce the power consumption, a pixel portion may be formed over a glass substrate using TFTs, signal line driver circuits may all be formed over an IC chip, and then the IC chip may be mounted on a display panel by COG (Chip On Glass).

It is to be noted that a pixel portion may be formed over a substrate using TFTs, peripheral driver circuits may all be formed over an IC chip, and then the IC chip may be mounted on a display panel by COG (Chip On Glass). It is to be noted that FIG. 30B shows a configuration example where a pixel portion is formed over a substrate and an IC chip including a signal line driver circuit is formed over the same substrate by COG or the like.

Figure 32:
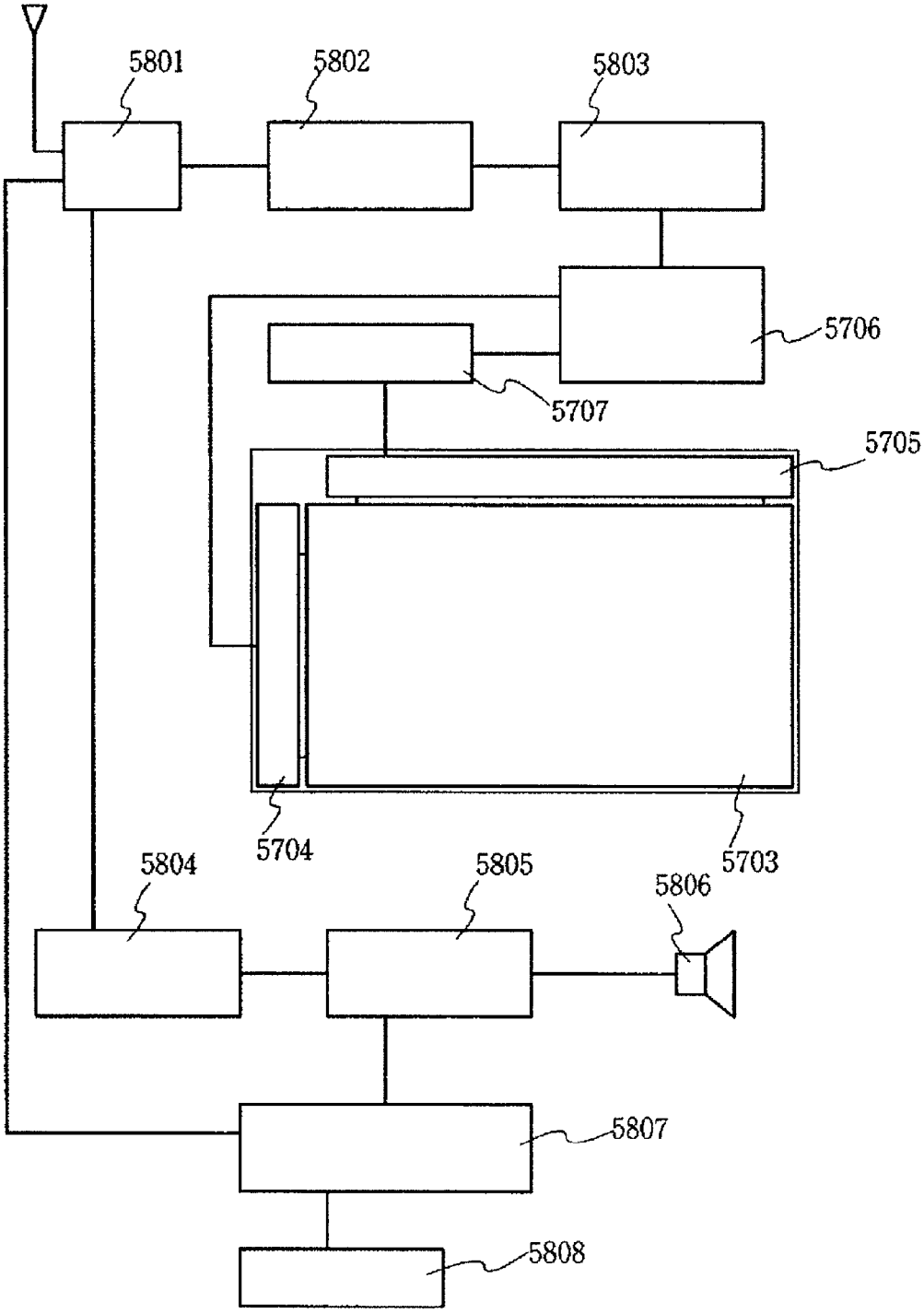
FIG. 32 is a diagram explaining a structure of a display device of the present invention.

An EL television receiver can be completed using this EL module. FIG. 32 is a block diagram showing a main configuration of an EL television receiver. A tuner 5801 receives a picture signal and an audio signal. The video signal is processed by a picture signal amplifier circuit 5802, a picture signal processing circuit 5803 for converting the signal outputted from the picture signal amplifier circuit 5802 into a color signal corresponding to each of red, green, and blue, and a control circuit 5706 for converting the picture signal into input specifications to a driver circuit. The control circuit 5706 outputs a signal to each of a scanning line side and a signal line side. In a case of a digital driving, a signal division circuit 5707 may be provided on the signal line side so that an input digital signal is divided into m signals to be supplied.

The audio signal among the signals received by the tuner 5801 is transmitted to an audio signal amplifier circuit 5804 and the output thereof is supplied to a speaker 5806 through an audio signal processing circuit 5805. A control circuit 5807 receives control data such as a receiving station (reception frequency) and a volume from an input portion 5808, and sends out a signal to the tuner 5801 and the audio signal processing circuit 5805.

A television receiver can be completed by incorporating the EL module in a housing. The EL module constitutes a display portion. In addition, a speaker, a video input terminal, or the like are provided appropriately.

It is needless to say that the present invention is applicable not only to a television receiver but to various applications such as a monitor of a personal computer and particularly large area display media typified by an information display panel at train stations, airports or the like, and an advertising display panel on the streets.

In this manner, by using the display device of the present invention and the driving method thereof, an image where pseudo contours are reduced can be displayer. Therefore, even an image like human skin where gray scales subtly change can be displayed with pseudo contours reduced.

Embodiment Mode 9

As examples of an electronic device to which the present invention is applicable, a display of a desktop, floor-stand or wall-hung type; a video camera; a digital camera; a goggle display (e.g., a head mounted display); a navigation system; an audio reproducing device (e.g., a car audio or an audio component stereo); a computer; a game machine; a portable information terminal (e.g., a mobile computer, a cellular phone, a portable game machine, or an electronic book); an image reproducing device provided with a recording medium (specifically, a device for reproducing pictures or still images recorded in a recording medium such as a Digital Versatile Disc (DVD) and having a display portion for displaying the reproduced image); or the like can be given. FIGS. 33A to 33H show specific examples of such electronic devices.

Figure 33A:
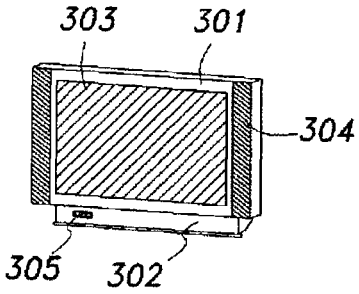
FIGS. 33A to 33H are views each explaining an electronic device to which the present invention is applied.

FIG. 33A shows a display of a desktop, floor-stand or wall-hung type, which includes a housing 301, a supporting base 302, a display portion 303, a speaker portion 304, a video input terminal 305, and the like. The present invention can be used for a display device including the display portion 303. Such a display can be used as an arbitrary display device used for displaying information, for example, for a personal computer, for TV broadcast reception, or for advertisement display. Consequently, the display capable of performing display without a false contour can be provided.

Figure 33B:
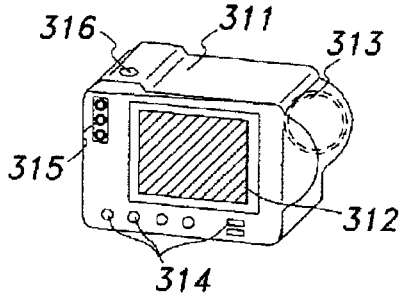

FIG. 33B shows a digital camera, which includes a main body 311, a display portion 312, an image receiving portion 313, operating keys 314, an external connection port 315, a shutter 316, and the like. The present invention can be used for a display device including the display portion 312. Consequently, the digital camera capable of performing display without a false contour can be provided.

Figure 33C:
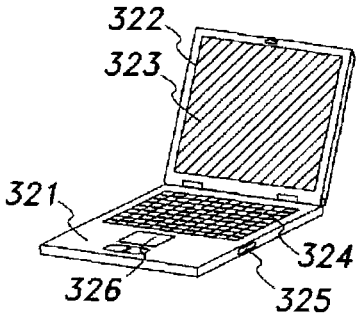

FIG. 33C is a computer, which includes a main body 321, a housing 322, a display portion 323, a keyboard 324, an external connection port 325, a pointing mouse 326, and the like. The present invention can be used for a display device including the display portion 323. Consequently, the computer capable of performing display without a false contour can be provided. It is to be noted that the computer includes a so-called laptop computer where a central processing unit (CPU), a recording medium, and the like are mounted, and a so-called desktop computer where they are provided separately.

Figure 33D:
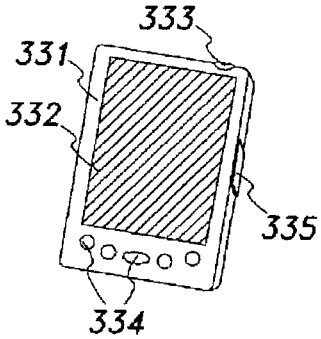

FIG. 33D shows a mobile computer, which includes a main body 331, a display portion 332, a switch 333, operating keys 334, an infrared port 335, and the like. The present invention can be used for a display device including the display portion 332. Consequently, the mobile computer capable of performing display without a false contour can be provided.

Figure 33E:
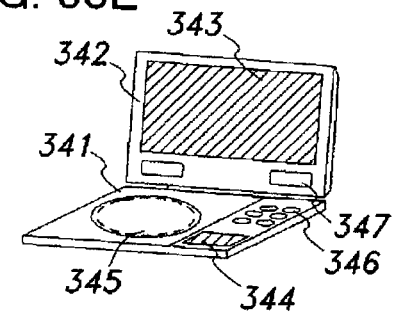

FIG. 33E shows a portable image reproducing device provided with a recording medium (specifically, a DVD reproducing device), which includes a main body 341, a housing 342, a first display portion 343, a second display portion 344, a recording medium (DVD or the like) reading portion 345, operating keys 346, a speaker portion 347, and the like. The first display portion 343 mainly displays image data, and the second display portion 344 mainly displays text data. The present invention can be used for a display device including the first and second display portions 343 and 344. Consequently, the image reproducing device capable of performing display without a false contour can be provided. It is to be noted that an image reproducing device provided with a recording medium includes a home-use game machine and the like.

Figure 33F:
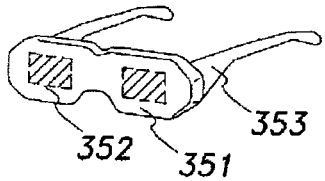

FIG. 33F shows a goggle type display (a head mounted display), which includes a main body 351, a display portion 352, an arm portion 353, and the like. The present invention can be used for a display device including the display portion 352. Consequently, the goggle type display capable of performing display without a false contour can be provided.

Figure 33G:
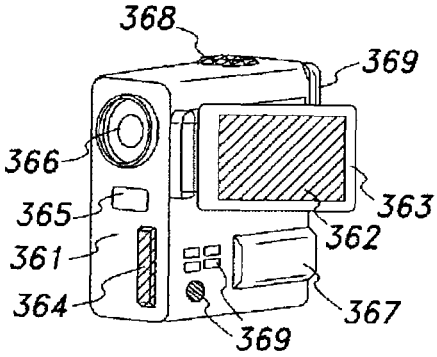

FIG. 33G shows a video camera, which includes a main body 361, a display portion 362, a housing 363, an external connection port 364, a remote control receiving portion 365, an image receiving portion 366, a battery 367, an audio input portion 368, operating keys 369, and the like. The present invention can be used for a display device including the display portion 362. Consequently, the video camera capable of performing display without a false contour can be provided.

Figure 33H:
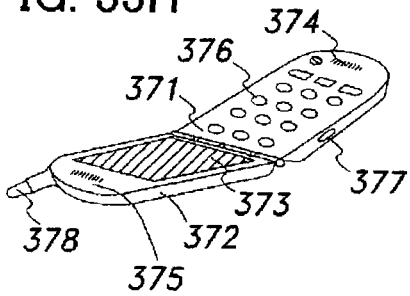
Figure 34:
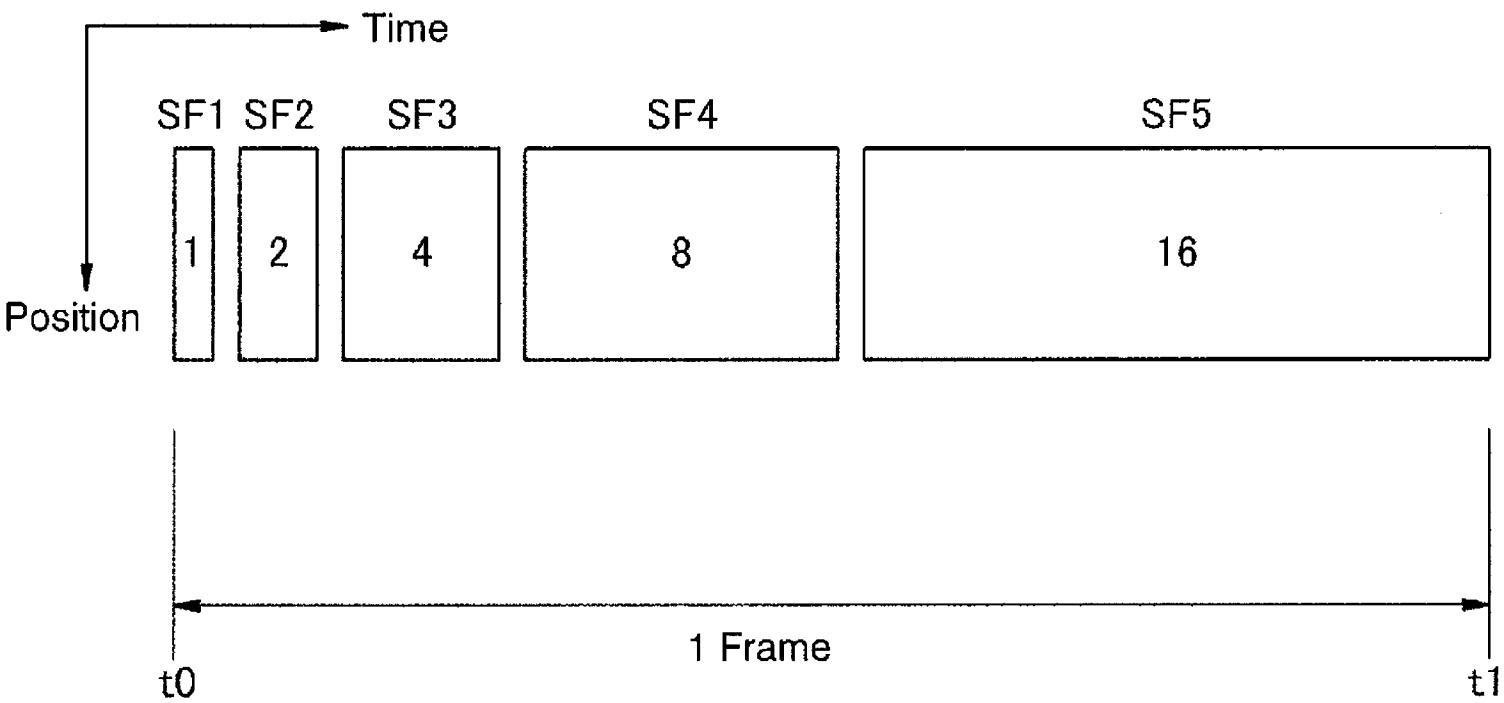
FIG. 34 is a diagram explaining a structure of a driving method of a conventional display device.

FIG. 33H is a cellular phone, which includes a main body 371, a housing 372, a display portion 373, an audio input portion 374, an audio output portion 375, operating keys 376, an external connection port 377, an antenna 378, and the like. The present invention can be used for a display device including the display portion 373. Consequently, the cellular phone capable of performing display without a false contour can be provided.

The display portions of the electronic devices as described above may be formed as a self-light-emitting type in which a light-emitting element such as an LED or an organic EL is used in each pixel, or may be formed as another type in which a light source such as a backlight is used like a liquid crystal display. In the case of a self-light-emitting type, no backlight is required and a display portion can be thinner than a liquid crystal display.

Moreover, the above electronic devices have been increasingly used for displaying information distributed through an electronic communication line such as the Internet and a CATV (cable television) or as TV receptors. In particular, an opportunity for displaying moving image information is increasing. A display device of a self-light-emitting type is suitable for such a moving image display since a light-emitting material such as an organic EL responds much faster than that of a liquid crystal. In addition, it is also suitable for performing time division driving. When the luminance of a light-emitting material is increased, the light-emitting material can be used for a front or rear projector by magnifying and projecting outputted light containing image data by a lens or the like.

Since a light-emitting portion of a self-light-emitting display portion consumes power, it is desirable to display information using a light-emitting portion so as to be decreased as much as possible. Therefore, in the case where a display portion of a portable information terminal, in particular, of a cellular phone, a sound reproduction apparatus or the like which mainly displays text data is of a self-light-emitting type, it is desirable to perform driving so that light-emitting portions display text data while non-light-emitting portions serve as the background.

As described through the above, the application range of the present invention is so wide that the present invention is applicable to electronic devices of all fields.

This application is based on Japanese Patent Application serial No. 2006-012464 filed in Japan Patent Office on Jan. 20, 2006, the entire contents of which are hereby incorporated by reference.

What is claimed is:

1. An electronic book comprising:

a pixel comprising a transistor and a display element;

a driver circuit for driving the pixel; and a circuit for controlling the driver circuit such that a plurality of signals is inputted into the pixel to express gray scales and such that a first direction bias voltage and a second direction bias voltage are applied to the display element, wherein a direction of the first direction bias voltage is opposite to a direction of the second direction bias voltage, wherein the circuit is configured to control the driver circuit such that there are a plurality of patterns of applying a voltage to the display element in a case where a same gray scale level having a same weight is expressed, and wherein one frame comprises:

a plurality of middle-order sub-frames which is used for an overlapping time gray scale method, each middle-order sub-frame of the plurality of middle-order subframes having a same middle-degree weighting, a high-order sub-frame which has a larger weighting than that of a middle-order sub-frame of the plurality of middle-order sub-frames and is used for a binary code time gray scale method, and a low-order sub-frame which has a smaller weighting than that of the middle-order sub-frame of the plurality of middle-order sub-frames and is used for the binary code time gray scale method.

2. The electronic book according to claim 1, wherein the transistor has a bottom-gate structure.

3. The electronic book according to claim 1, wherein the transistor has a top-gate structure.

4. An electronic book comprising:

a pixel comprising a transistor and a display element;

a driver circuit for driving the pixel; and a circuit for controlling the driver circuit such that a plurality of signals is inputted into the pixel to express gray scales and such that a first direction bias voltage and a second direction bias voltage are applied to the display element, wherein a direction of the first direction bias voltage is opposite to a direction of the second direction bias voltage, wherein the driver circuit and the pixel are formed over a same substrate, wherein the circuit is configured to control the driver circuit such that there are a plurality of patterns of applying a voltage to the display element in a case where a same gray scale level having a same weight is expressed, and wherein one frame comprises:

a plurality of middle-order sub-frames which is used for an overlapping time gray scale method, each middle-order sub-frame of the plurality of middle-order subframes having a same middle-degree weighting, a high-order sub-frame which has a larger weighting than that of a middle-order sub-frame of the plurality of middle-order sub-frames and is used for a binary code time gray scale method, and a low-order sub-frame which has a smaller weighting than that of the middle-order sub-frame of the plurality of middle-order sub-frames and is used for the binary code time gray scale method.

5. The electronic book according to claim 4, wherein the transistor has a bottom-gate structure.

6. The electronic book according to claim 4, wherein the transistor has a top-gate structure.

7. The electronic book according to claim 4, wherein the same substrate is a glass substrate.

8. The electronic book according to claim 4, wherein the same substrate is a plastic substrate.

9. The electronic book according to claim 4, wherein the same substrate is an SOI substrate.

10. An electronic book comprising:

a pixel comprising a transistor and a display element;

a driver circuit for driving the pixel; and a circuit for controlling the driver circuit such that a plurality of signals is inputted into the pixel to express gray scales and such that a first direction bias voltage and a second direction bias voltage are applied to the display element, wherein a direction of the first direction bias voltage is opposite to a direction of the second direction bias voltage, wherein the circuit is configured to control the driver circuit such that a number of applications of a voltage to the display elmeent in a first mode and a number of applications of the votlage to the display element in a second mode to express a same gray scale level having a same wegiht are different from each other, and wherein one frame comprises:

a plurality of middle-order sub-frames which is used for an overlapping time gray scale method, each middle-order sub-frame of the plurality of middle-order subframes having a same middle-degree weighting, a high-order sub-frame which has a larger weighting than that of a middle-order sub-frame of the plurality of middle-order sub-frames and is used for a binary code time gray scale method, and a low-order sub-frame which has a smaller weighting than that of the middle-order sub-frame of the plurality of middle-order sub-frames and is used for the binary code time gray scale method.

11. The electronic book according to claim 10, wherein the transistor has a bottom-gate structure.

12. The electronic book according to claim 10, wherein the transistor has a top-gate structure.

13. An electronic book comprising:

a pixel comprising a transistor and a display element;

a driver circuit for driving the pixel; and a circuit for controlling the driver circuit such that a plurality of signals is inputted into the pixel to express gray scales and such that a first direction bias voltage and a second direction bias voltage are applied to the display element, wherein a direction of the first direction bias voltage is opposite to a direction of the second direction bias voltage, wherein the driver circuit and the pixel are formed over a same substrate, wherein the circuit is configured to control the driver circuit such that a number of applications of a voltage to the display elmeent in a first mode and a number of applications of the votlage to the display element in a second mode to express a same gray scale level having a same wegiht are different from each other, and wherein one frame comprises:

a plurality of middle-order sub-frames which is used for an overlapping time gray scale method, each middle-order sub-frame of the plurality of middle-order subframes having a same middle-degree weighting, a high-order sub-frame which has a larger weighting than that of a middle-order sub-frame of the plurality of middle-order sub-frames and is used for a binary code time gray scale method, and a low-order sub-frame which has a smaller weighting than that of the middle-order sub-frame of the plurality of middle-order sub-frames and is used for the binary code time gray scale method.

14. The electronic book according to claim 13, wherein the transistor has a bottom-gate structure.

15. The electronic book according to claim 13, wherein the transistor has a top-gate structure.

16. The electronic book according to claim 13, wherein the same substrate is a glass substrate.

17. The electronic book according to claim 13, wherein the same substrate is a plastic substrate.

18. The electronic book according to claim 13, wherein the same substrate is an SOI substrate.

* * * * *

UNITED STATES PATENT AND TRADEMARK OFFICE

CERTIFICATE OF CORRECTION

PATENT NO. : 8,659,520 B2
APPLICATION NO. : 12/834092
DATED : February 25, 2014
INVENTOR(S) : Hajime Kimura It is certified that error appears in the above-identified patent and that said Letters Patent is hereby corrected as shown below:

In the Claims:

Column 30, line 11, in claim 10 replace “elmeent” with --element--;

Column 30, line 12, in claim 10 replace “votlage” with --voltage--;

Column 30, line 14, in claim 10 replace “wegiht” with --weight--;

Column 30, line 47, in claim 13 replace “elmeent” with --element--;

Column 30, line 48, in claim 13 replace “votlage” with --voltage--;

Column 30, line 50, in claim 13 replace “wegiht” with --weight--.

Signed and Sealed this
Twenty-ninth Day of July, 2014

Michelle K. Lee

Michelle K. Lee
*Deputy Director of the United States Patent and Trademark Office*